US006986669B2

(12) United States Patent
Kawai

(10) Patent No.: US 6,986,669 B2
(45) Date of Patent: Jan. 17, 2006

(54) ELECTRICALLY CONDUCTIVE CONTACT MEMBER FOR A PRINTED CIRCUIT BOARD

(75) Inventor: Tsutomu Kawai, Nagoya (JP)

(73) Assignee: Kitagawa Industries Co., Ltd., Nagoya (JP)

( * ) Notice: Subject to any disclaimer, the term of this patent is extended or adjusted under 35 U.S.C. 154(b) by 0 days.

(21) Appl. No.: 10/795,053

(22) Filed: Mar. 5, 2004

(65) Prior Publication Data

US 2004/0175972 A1 Sep. 9, 2004

(30) Foreign Application Priority Data

Mar. 7, 2003 (JP) ..... 2003-062404
Dec. 8, 2003 (JP) ..... 2003-409565

(51) Int. Cl.
*H01R 12/00* (2006.01)

(52) U.S. Cl. ..... 439/66; 439/884; 174/267

(58) Field of Classification Search ..... 439/66, 439/74, 81, 83, 884; 174/35 C, 261, 267
See application file for complete search history.

(56) References Cited

U.S. PATENT DOCUMENTS 3,954,317 A * 5/1976 Gilissen et al. ..... 439/66
5,180,311 A 1/1993 Schreiber et al.
5,273,439 A * 12/1993 Szerlip et al. ..... 439/66
5,427,535 A 6/1995 Sinclair ..... 439/66
5,540,594 A 7/1996 Collins et al. ..... 439/66
5,868,582 A * 2/1999 Jacobi ..... 439/74
5,938,451 A * 8/1999 Rathburn ..... 439/66
6,255,581 B1 7/2001 Reis et al.
6,359,215 B1 3/2002 Horng
2002/0053468 A1 5/2002 Yumi

FOREIGN PATENT DOCUMENTS

JP 2002-510873 4/2002
WO WO-01/54232 A2 7/2001

* cited by examiner

*Primary Examiner*—Tho D. Ta
*Assistant Examiner*—Larisa Tsukerman
(74) *Attorney, Agent, or Firm*—Davis & Bujold, P.L.L.C.

(57) ABSTRACT

A contact member formed with a flat metal structure and an integrated elastomeric body. The contact member can be used to ground a printed circuit board (PCB) with a surrounding housing. The housing loads the contact member in a direction perpendicular to the face of the PCB. The elastomeric body supports the flat metal structure during repeated cycles of loading and unloading of the contact member. The elastic resiliency of the elastomeric body can help to reduce the effects of plastic deformation of the contact member, resulting in more reliable electrical connections a source outside of the PCB. And the elastomeric body does not require adhesive or separate fixing devices to hold it in place.

17 Claims, 14 Drawing Sheets

ELECTRICALLY CONDUCTIVE CONTACT MEMBER FOR A PRINTED CIRCUIT BOARD

FIELD OF THE INVENTION

The present invention relates to a contact member to be mounted on the surface of a printed circuit board and to achieve electrical conduction between a ground pattern on the printed circuit board and a grounding conductor.

BACKGROUND OF THE INVENTION

There is a conventionally known technique in which a contact member is mounted on the surface of a around pattern on a printed circuit board and, in that state, the printed circuit board is fixed in such a manner that the contact member is pressed against a grounding conductor, such as a chassis or the like. Thereby a ground pattern on the printed circuit board is electrically grounded to the grounding conductor via the contact member. Especially, in recent years, as more and more instruments having microcomputers built therein have been manufactured with the development of computer technology, the aforementioned technique is now indispensable for grounding printed circuit boards within such instruments.

This kind of contact member is likely to be formed by a conductive elastic sheet to ensure electrical conduction between a ground pattern on a printed circuit and a grounding conductor. Also, this contact member is sometimes combined with a conductive elastic body for the purpose of electromagnetic shield for use.

For example, in Publication of Japanese Unexamined Patent Application No. 2002-510873, situation is disclosed where a conductive gasket member is provided to a contact member made of plate metal in which a pair of spring-like finger parts are bent back from an end.

When a contact member is disposed between a ground pattern on a printed circuit and a grounding conductor such as a housing etc., tightening the cover of the housing by a bolt means risking that the contact member will be plastically deformed. This would result in the contact member losing its spring characteristics and not being able to elastically recover toward its original configuration. Once elastic resilience is lost, for example, when the housing is opened and closed repeatedly, the contact between the contact member and the housing may not be maintained, resulting in a chance of conductive failure.

The conductive gasket, disclosed in FIG. 10 of the Publication of Unexamined Japanese Patent Application No. 2002-510873, is considered by some to resist against the force which is attempting to crush a finger of the contact member. However, there is no reference in the above Japanese Patent Application to the problem of the case in which the elastic resilience of the finger is lost, and no description of measures to guard against the situation in which elastic resilience of the finger is lost.

SUMMARY OF THE INVENTION

An object of the present invention is to decrease the effect of plastic deformation of a contact member which is disposed between a ground pattern on a printed circuit board and a grounding conductor.

To attain the above and other objects, there is provided a contact member comprising a thin sheet member and an elastomeric body which may both be conductive and elastic.

The thin sheet member includes a base part of which at least a portion is mounted on the surface of a ground pattern on a printed circuit board, a contact part which is provided facing the base part and becomes a joint area with a contact element on a surface providing a grounding conductor different from the printed circuit board on which the base part is mounted, and a supporting spring part which is connected to a part of the base part and to a base end of the contact part and which supports the contact part in such a manner that the contact part can be elastically deformed in the direction perpendicular to the plane of the base part. The elastomeric body is disposed between the base part and the contact part and is attached to the supporting spring part by allowing a part of the supporting spring part to penetrate through the inside of the elastomeric body.

A part of the base part is mounted on the surface of a ground pattern whereby this contact member is attached to a printed circuit board. By pressing a grounding conductor against the contact part provided facing the base part (for example, parallel to the base part), electrical conduction between a ground pattern on a printed circuit board and a grounding conductor is achieved.

The thin sheet member may preferably be composed of a single piece of sheet material. However, plural pieces of sheet material may be connected for use by spot welding or the like. The supporting spring part, which is connected to a part of the base part and to a base end of the contact part, supports the contact part in such a manner that the contact part can be elastically deformed in a direction perpendicular to the plane of the base part. Consequently, when the contact part is pressed by a grounding conductor, the contact part is elastically deformed in the direction of approaching the base part. The elastic repulsive force of the contact part caused by this deformation strengthens the contact between the contact part and a grounding conductor. As a consequence, the electrical conduction between a ground pattern and a grounding conductor can be favorably achieved.

When an external force is applied to elastically deform the contact part, the elastomeric body is elastically deformed. When the external force is released, the elastomeric body sustains an elastic recovery. Therefore, even if the force to elastically deform the contact part becomes excessive, the elastomeric body is a resistance against this force. As a result, it is avoided that the contact part is plastically deformed and that the spring characteristics of the contact part are lost.

In addition, even if the spring characteristics of the contact part are lowered and the recovery ability is decreased, the elastomeric body can compensate for the spring characteristics and provide a sufficient recovery ability. For this reason, if the spring characteristics of the contact part are lowered (or lost), the contact part can return toward its original configuration. Therefore, for example, when a housing is opened and closed repeatedly, the contact between the contact member and a grounding conductor is maintained, thus avoiding conductive failure.

Further in addition, the elastomeric body is attached to the supporting spring part by allowing a part of the support spring part to penetrate through the inside of the elastomeric body. As a result, for example, in spite of a repeated sequence of compression and release of the spring member, or other changes such as thermal expansion etc., there is little risk that the elastomeric body will be removed from the supporting spring part. In case of only using adhesive agents, there is a possibility that expansion and contraction changes may cause the adhesive agents to be removed.

Therefore it is not necessary to separately adhere the elastomeric body and the supporting spring part by adhesive agents or the like. Thus it is possible to use hard-to-adhere materials for the elastomeric body. Yet, the use of adhesive agents is not prohibited. Adhesive agents may be used based upon the material selections and operating environment of the elastomeric body.

In case of allowing a part of the supporting spring part to enter through the inside of the elastomeric body, the elastomeric body may be provided with a hole so that the entering part of the supporting spring part may pass through this hole. Alternatively, the elastomeric body may be provided with a groove deep enough that the entering part of the supporting spring part is contained, so that the supporting spring part may pass through this groove.

Also, a grounding conductor, which contacts and elastically deforms the supporting spring part, firstly abuts the supporting spring part, because the elastic body is only disposed between the base part and the supporting spring part. Therefore, the elastomeric body does not obstruct earth conduction between a grounding conductor and the supporting spring part.

Although it should be clear from this explanation, even though the elastomeric body may be made large enough to protrude beyond the base part or the contact part, it is preferable that the elastomeric body fits within the imaginary extended surfaces of the base part and of the contact part.

A basis of the material of the elastomeric body may be an elastomer. However, conductive particle and fiber such as filler etc. may be compounded therein for example. In case that conductive particles etc. are compounded into the elastomeric body or the like in order to achieve electrical conduction, the conductive distance between a ground pattern and a grounding conductor may become much shorter.

In the contact member, the elastomeric body is in contact with the contact part and the base part even in the state in which an external force needed to cause elastic deformation of the contact part is not applied to the contact member. As a result, when an external force which may elastically deform the contact part in the direction of the base part is subjected to the contact member, the external force immediately acts upon the elastomeric body as well. Therefore, the function of the elastomer body is performed more favorably.

In the contact member, the contact part comprises an attachment surface which can be grasped by an automatic mounting machine. This enables the contact member to be mounted on a printed circuit board using the automatic mounting machine.

In the contact member, the attachment surface and the base part are approximately parallel to each other in an unloaded state. Moreover, the attachment surface is set to maintain a substantially parallel relationship relative to the base part even when the contact part is elastically deformed in the direction of approaching the base part. Therefore, even if an elastic deformation is caused by abutment of the vacuum suction nozzle of the vacuum suction automatic mounting machine, gaps between the nozzle and the attachment surface are restrained. Because of this, the grasp of the contact member can be performed relatively efficiently. Thereby efficiency in the overall automatic mounting operation can be improved.

In the contact member, the elastomeric body is provided with a hollow part in a portion thereof under the contact part.

When the elastomeric body is compressively deformed, the hollow part provided to the elastomeric body in the portion under the contact part becomes a deformation allowing space for the elastomeric body. As a result, when the supporting spring part is elastically deformed in the direction that makes the contact part move closer to the base part, the initial resistance of the elastomeric body is decreased. In short, the ability to prevent the plastic deformation of the end portion of the contact part is enhanced because an excessive force is not applied by the elastomeric body to the supporting spring part and/or the contact part.

Preferably by allowing a portion of the elastomeric body located under the end part of the contact part to be the hollow part, an excessive force is inhibited from being applied to the end part of the contact part. As long as the hollow part is constructed so as to become the deformation allowing space when the elastic body is compressively deformed, the hollow part is not limited to a specific configuration and size. However, if the hollow part is configured to have a cavity in which at least one end is opened, the hollow part can be formed by injection molding.

In the contact member, the hollow part is preferably a longitudinal hole penetrating from the base part to the contact part. Therefore, the aforementioned effect of allowing injection molding, achieved by having a hollow shape in which at least one end is opened, can be obtained.

In the contact member, the hollow part is preferably a side hole penetrating along a direction perpendicular to the displacement direction of the supporting spring part when the supporting spring part is elastically deformed. This is the direction in which the contact part approaches and retreats from the base part. In addition, the ability to injection mold, achieved by having a hollow shape in which at least one end is opened, can be obtained.

Alternatively, in the early stage of the compressive deformation of the elastomeric body, the side hole is not greatly contracted. Thus, the resistance of the elastomeric body against this deformation is initially small, preferably helping to prevent excessive force from being applied to the supporting spring part as well as to the contact part, and also helping to reduce the amount of initial plastic deformation. On the other hand, if the compressive deformation of the elastomeric body continues to increase, whereby the side hole is substantially contracted, the resistance of the elastomeric body against the deformation force becomes much greater, thus preventing the excessive deformation (for example, crushing) of the supporting spring part. The function of inhibiting excessive deformation is valid for the contact part as well.

In the contact member of the present invention, at least a part of the base part is mounted on the surface of a ground pattern on a printed circuit board. This mounting is usually performed by soldering. Therefore, it is preferable that materials resistant to the heating caused by the soldering operation (generally a maximum temperature of about 260° C.) should be used for the elastomeric body.

BRIEF DESCRIPTION OF THE DRAWINGS

The present invention will now be described, by way of example, with reference to the accompanying drawings, in which.

DESCRIPTION OF THE PREFERRED EMBODIMENTS

[First Embodiment]

Figure 1A:
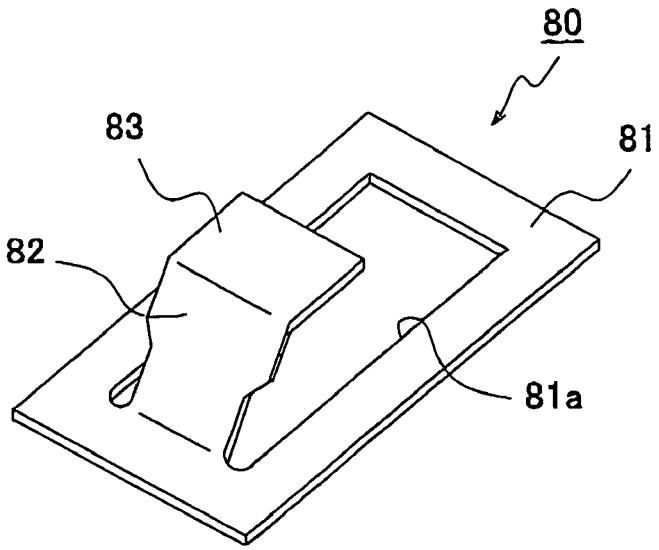
FIG. 1A is a perspective view of a thin sheet member of a contact member according to a first embodiment of the invention.
Figure 1B:
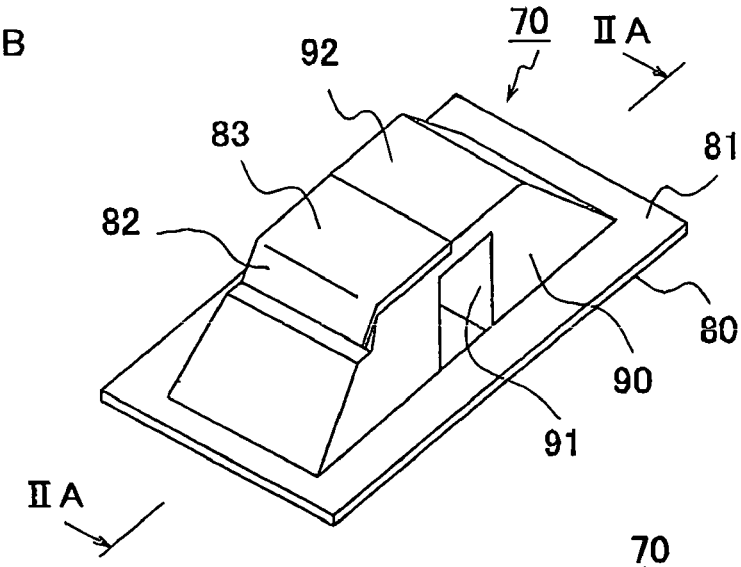
FIG. 1B is a top perspective view of the contact member according to the first embodiment of the invention.
Figure 1C:
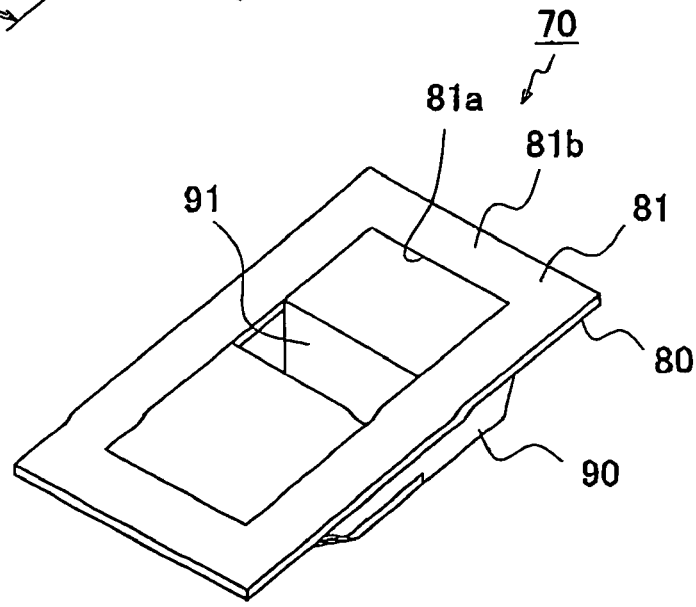
FIG. 1C is a bottom perspective view of the contact member shown in FIG. 1B.

As illustrated in FIGS. 1A, 1B, and 1C, a contact member 70 comprises a thin sheet member 80 and an elastomeric body 90.

The thin sheet member 80 may be made of plate metal (a material such as beryllium copper and phosphor bronze for example) and its thickness may be in the range of 0.3 mm to 0.8 mm. Known press operation, such as stamping out and bending or the like, is performed to the thin sheet member 80. A base part 81, a supporting spring part 82, and a contact part 83 are provided thereto.

The base part 81 may have a substantially rectangular shape. In the middle area thereof, a longitudinal hole 81*a*, having a substantially rectangular shape, is formed by cutting and raising the supporting spring part 82 and the contact part 83. Therefore, a joint surface 81*b*, which is to be soldered to a circuit pattern on a printed circuit board, is the undersurface of the surrounding area of the longitudinal hole 81*a*.

The supporting spring part 82 is an incline connected to the base part 81 at one side of the longitudinal hole 81*a*. The end portion of the supporting spring part 82 is bent approximately parallel to the base part 81, forming the flat contact part 83.

The supporting spring part 82 can be elastically deformed in a direction causing the contact part 83 to move closer to the base part 81 (the joint surface 81*b*) or in the opposite direction about an area in which the supporting spring part 82 is connected to the base part 81. The elastomeric body 90, having a shape of a square frustum, is preferably a silicone elastomer which resists heating to 260° C. In the middle area thereof, is provided a side hole 91 having a shape of approximately a rectangular prism. The side hole 91 has openings at total three places; two places facing the sides perpendicular to the side of the longitudinal hole 81*a* connected to the supporting spring part 82, and one place having an opening in the middle area of the longitudinal hole 81*a* at the undersurface of the elastomeric body 90.

Figure 2A:
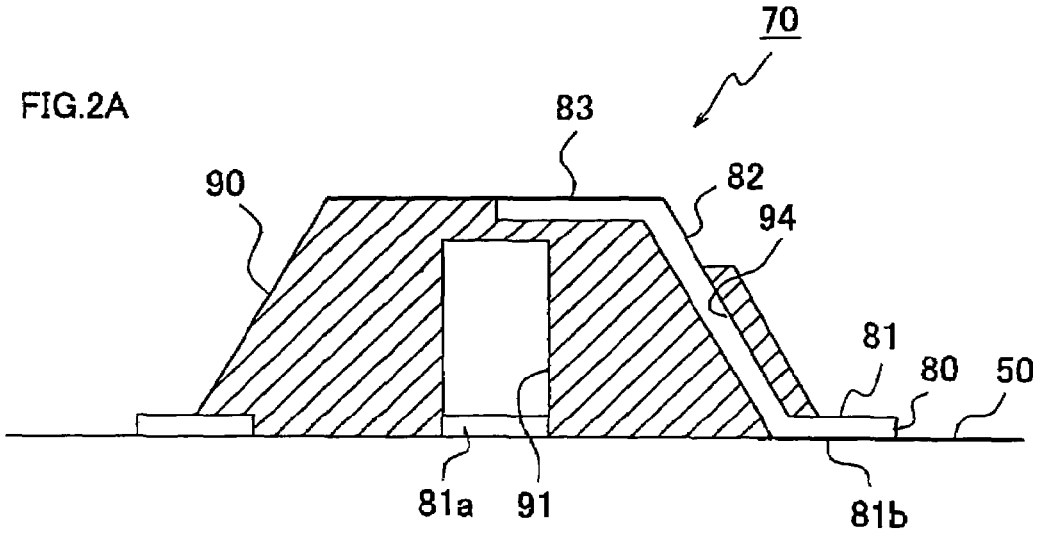
FIG. 2A is a cross sectional view taken along line IIA—IIA in FIG. 1B showing the state in which the contact member, according to the first embodiment of the invention, is mounted on a printed circuit board.

Also, as illustrated in FIG. 2A, a joint hole 94 is provided in the elastomeric body 90. The supporting spring part 82 penetrates through this joint hole 94 allowing the elastomeric body 90 to be attached to the thin sheet member 80.

Moreover, the bottom of the elastomeric body 90 fits within the longitudinal hole 81*a*. This also enables the combination of the elastomeric body 90 with the thin sheet member 80.

Figure 2B:
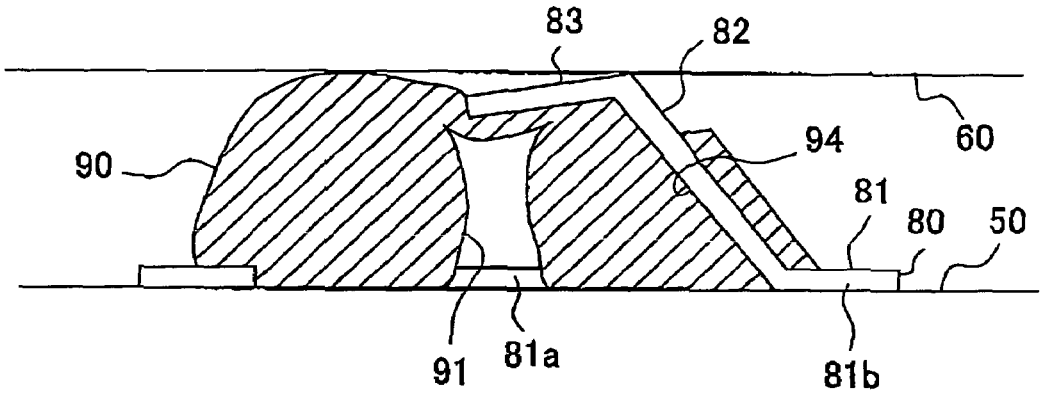
FIG. 2B and FIG. 2C are explanatory views according to the first embodiment of the invention at the time that the deforming amount of the contact member is respectively small and large.
Figure 2C:
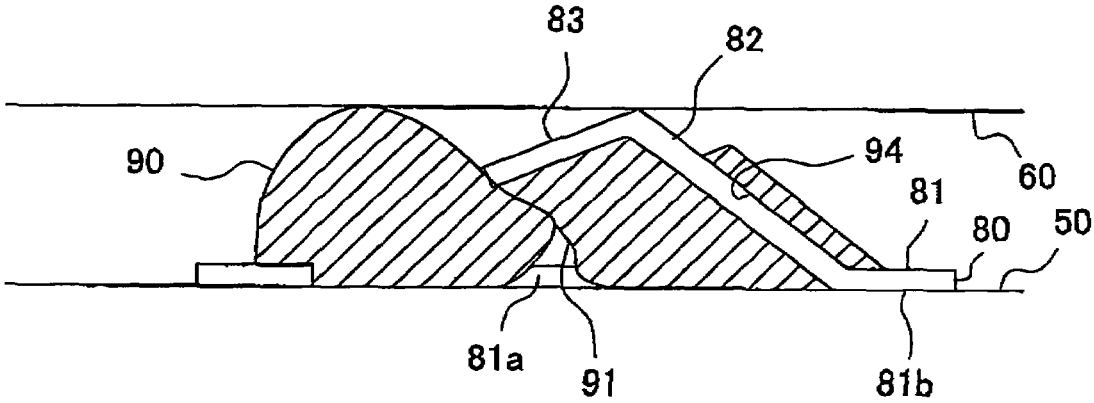

This contact member 70 is mounted for use on a printed circuit board 60 as illustrated in FIGS. 2A, 2B, and 2C. An attachment surface, more specifically, the upper surface of the contact part 83 (along with the upper surface 92 of the elastomeric body 90), is grasped by means of a vacuum suction automatic mounting machine in order to convey the contact member 70. This contact member 70 is disposed onto the printed circuit board 50 in such a manner that a joint surface 81*b* is in contact with solder paste located on a circuit pattern. The solder paste is melted by reflow soldering and cooled. Thereby, the contact member 70 is soldered to the printed circuit board 50. In FIGS. 2A, 2B, and 2C, the circuit pattern 51 and the solder paste 51*a* disposed between the joint surface 81*b* and the printed circuit board 50 are not shown in order to simplify the figures.

In the contact member 70 mounted onto the surface of the printed circuit board 50 in the aforementioned manner, the contact part 83 is pressed against a grounding conductor 60, such as a housing or the like, by the closing of the housing accommodating the printed circuit board 50.

The distance between the printed circuit board 50 and the grounding conductor 60 interposing the contact member 70 therebetween is set to be smaller than the height of the contact member 70 when it is not subjected to an external force. Consequently, a pressing force from the assembled grounding conductor 60 is applied to the contact part 83.

Because of this pressing force, as shown in FIG. 2B, the supporting spring part 82 is elastically deformed in such a manner that it rotates around the connecting part between the supporting spring part 82 and the base part 81. Additionally, this pressing force acts upon the elastomeric body 90 either through the supporting spring part 82 and the contact part 83, or directly, resulting in the elastic deformation of the elastomeric body 90 as though it were crushed.

The pressing force applied to the contact part 83 acts upon the elastomeric body 90 as well, so that the elastomeric body 90 adds to the resistance and the contact member 70 is not excessively deformed. Therefore, even if the force to elastically deform the contact member 70 becomes excessive as in the case above, the contact part 83 and the supporting spring part 82 avoid being only plastically deformed and losing a great deal of their spring characteristics.

When the elastomeric body 90 is elastically deformed in this way, the side hole 91 becomes a deformation allowing space for the elastomeric body 90. As a result, when the supporting spring part 82 is elastically deformed in the direction that drives the contact part 83 closer to the base part 81, the resistance of the elastomeric body 90 is initially decreased. In short, because an excessive force is not applied by the elastomeric body 90 to the supporting spring part 82 and the contact part 83, the ability to inhibit the plastic deformation of these parts is enhanced.

Also, when the amount of elastic deformation of the contact member 70 by a pressing force is small (at the early stage of deformation) as illustrated in FIG. 2B, the existence of the side hole 91 facilitates the deformation of the elastomeric body 90, thus allowing the elastomeric body 90 to be deformed as shown with little force.

When the amount of deformation is large, as illustrated in FIG. 2C, the inner walls of the side hole 91 come into contact with each other. Thus, the elastic repulsive force of the elastomeric body 90 gets larger than before and provides support for the contact part 83 as well as for the supporting spring part 82. Therefore, the elastomeric body 90 inhibits these parts from being deformed beyond the elastic limit; in other words, plastic deformation of the supporting spring part 82 and the contact part 83 is suppressed.

Although the elastomeric body 90 is disposed on the upper side of the base part 81, the grounding conductor 60, which elastically deforms the contact member 70, firstly abuts the contact part 83 (and the upper face 92 of the elastomeric body 90). Therefore, the elastomeric body 90 does not disturb the electric contact between the grounding conductor 60 and the contact part 83.

After the grounding conductor 60 is removed from the contact member 70 and the pressing force is released by the opening of the housing or the like, the elastomeric body 90 goes through an elastic recovery. Accordingly, even if the spring characteristics of the supporting spring part 82, which was deformed by the pressure of the grounding conductor 60, are lowered and the recovery ability of the supporting spring part 82 is decreased, the elastomeric body 90 compensates for the lost spring characteristics and provides a sufficient recovery ability. For this reason, even if the spring characteristics of the thin sheet member 80 are decreased (or lost), the contact part 83 can return toward its original state. Therefore, for example, when the housing is opened and closed repeatedly, the contact between the contact member 70 and the grounding conductor 60 is maintained, inhibiting conductive failure Furthermore, as the elastomeric body 90 is attached to the supporting spring part 82 by allowing a part of the supporting spring part 82 to penetrate into the joint hole 94, there is relatively no risk that the elastomeric body 90 is unintentionally removed from the supporting spring part 82 (in short, from the entire thin sheet member 80) because of either adhesion failure or deterioration of an adhesive. There is no need to separately adhere the elastomeric body 90 and the supporting spring part 82 with an adhesive or the like, so it is possible to use hard-to-adhere materials for the elastomeric body 90.

In the present embodiment, such a configuration is adopted that the elastomeric body 90 is in contact with the contact part 83 and the base part 81 even in the state in which an eternal force, which would cause the contact member 70 to be elastically deformed, is not applied to the contact member 70. Consequently, when an external force, which would cause the contact part 83 to be elastically deformed in the direction of the base part 81, is applied, it is immediately applied to the elastomeric body 90 as well.

Such a configuration may also be adopted that the elastomeric body 90 is in contact with neither the contact part 83 nor the base part 81 in an unloaded state. In this configuration, after the contact part 83 is displaced toward the base part 81 by more than a predetermined amount, the external force of the elastic deformation is applied to the elastomeric body 90 as well. By doing this, for example, when the amount of displacement of the contact part 83 (and/or the amount of elastic deformation of the supporting spring part 82) is small, only the elastic repulsive force of the thin sheet member 80 maintains the abutting conduction between the contact part 83 and the grounding conductor 60. Subsequently, the elastomeric body 90 inhibits the amount of elastic deformation of the supporting spring part 82 which would be considered excessive.

Furthermore, the upper surface of the contact part 83 of the contact member 70 in the present embodiment is flat. This upper surface becomes an attachment surface that can be grasped with an automatic mounting machine. Therefore, the flat upper surface is grasped by the automatic mounting machine, allowing the contact member 70 to be automatically mounted on the printed circuit board 50. In this respect, since the upper surface 92 of the elastomeric body 90 may also be used as an attachment surface, some deviation of the grasping position by the automatic mounting machine does not cause problems with respect to grasping.

[Second Embodiment]

The second embodiment uses an elastomeric body (the same type of material as in the first embodiment) having a side hole similar to the first embodiment; however, the configuration of the side hole is different from the first embodiment.

As illustrated in FIGS. 3A, and 3B, and FIGS. 4A, 4B, and 4C, the configuration of a side hole 101 provided to an elastomeric body 100 of the second embodiment is substantially a trapezoid. The present embodiment is similar to the first embodiment except for primarily this point. Accordingly, the components with the same configurations are denoted with the same reference numerals as in the first embodiment, and a description of the same components may not be repeated.

Figure 3A:
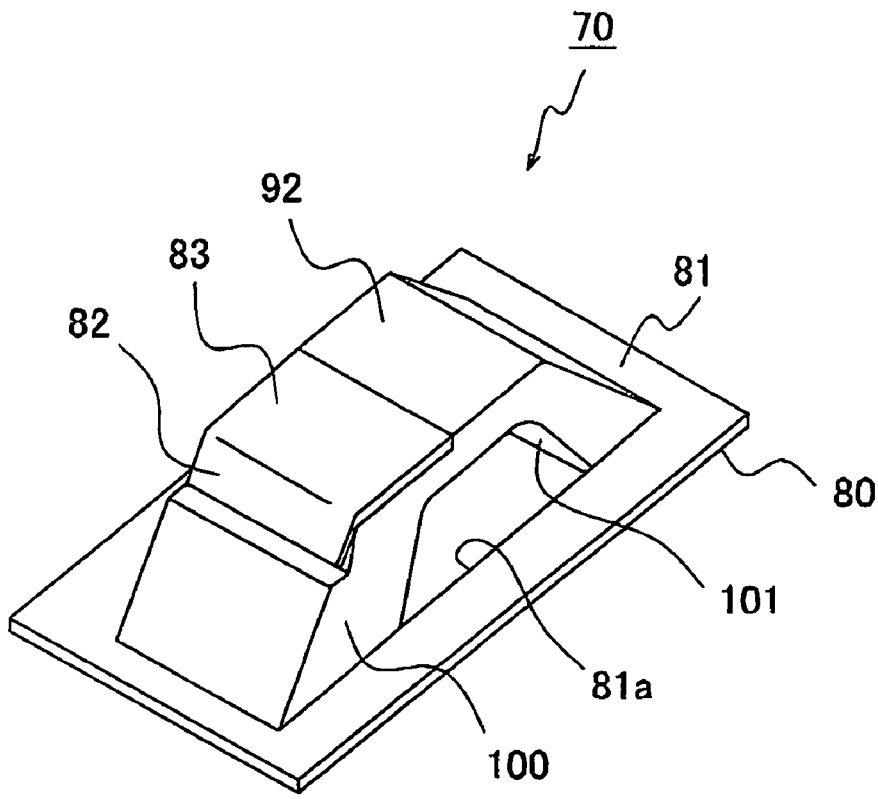
FIG. 3A and FIG. 3B are a top perspective view and a bottom perspective view of the contact member according to a second embodiment of the invention.
Figure 3B:
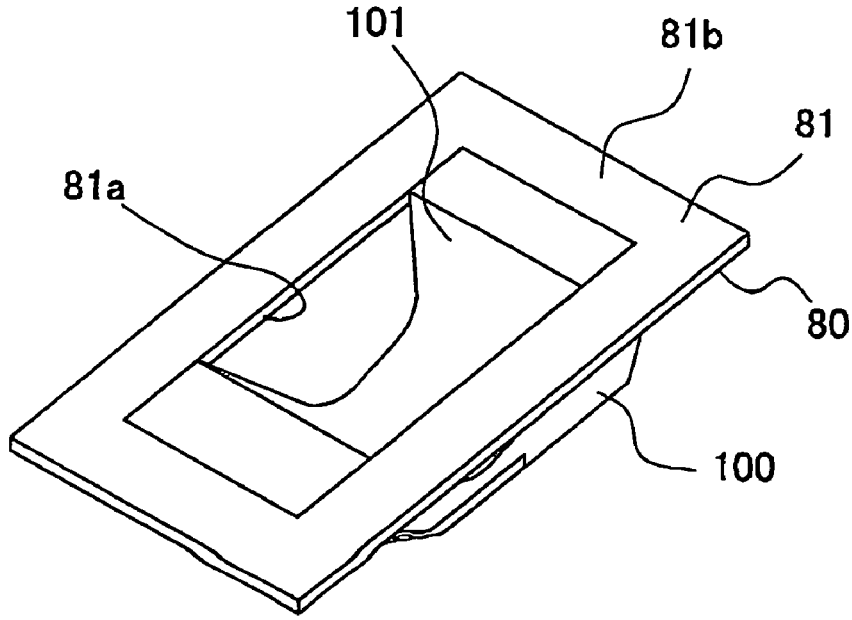

As illustrated in FIGS. 3A and 3B, an elastomeric body 100 of the present embodiment comprises a side hole 101. The side hole 101 is in the shape of approximately a trapezoid, and has openings at three places; two places facing the sides perpendicular to the side of the longitudinal hole 81*a* connected to the supporting spring part 82, and one place having an opening in the middle area of the longitudinal hole 81*a* at the undersurface of the elastomeric body 100.

Figure 4A:
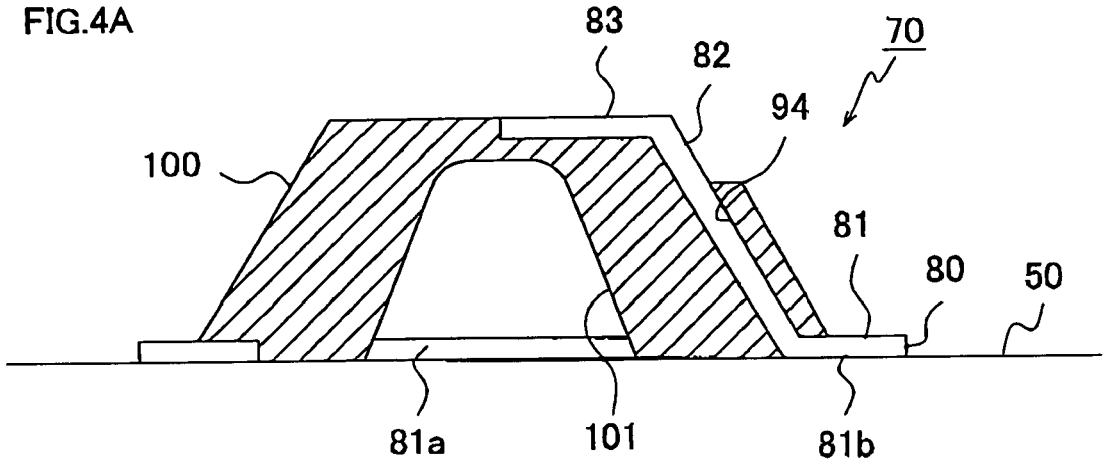
FIG. 4A is a cross sectional view according to the second embodiment of the invention showing the state in which the contact member is mounted on a printed circuit board.
Figure 4B:
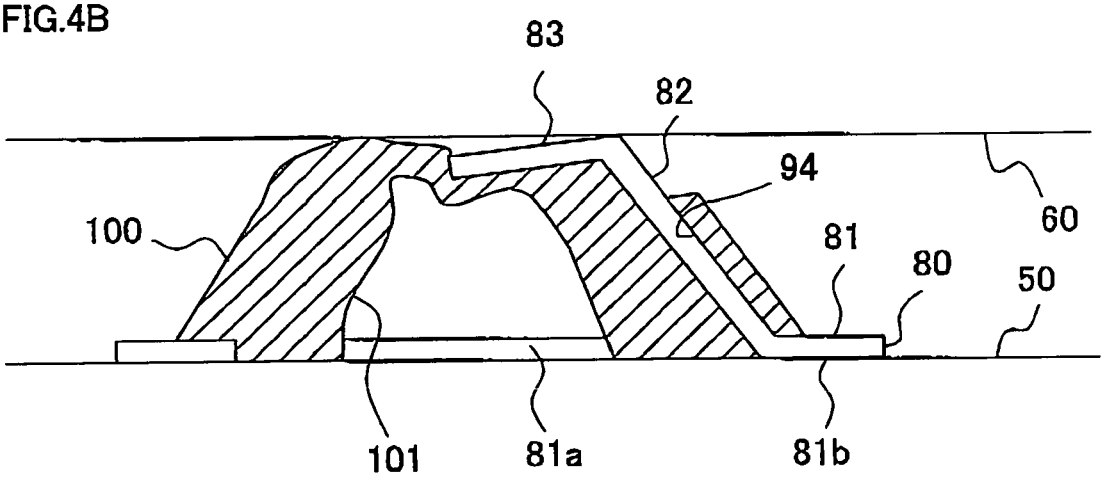
FIG. 4B and 4C are explanatory views according to the second embodiment of the invention at the time the deforming amount of the contact member is respectively small and large.
Figure 4C:
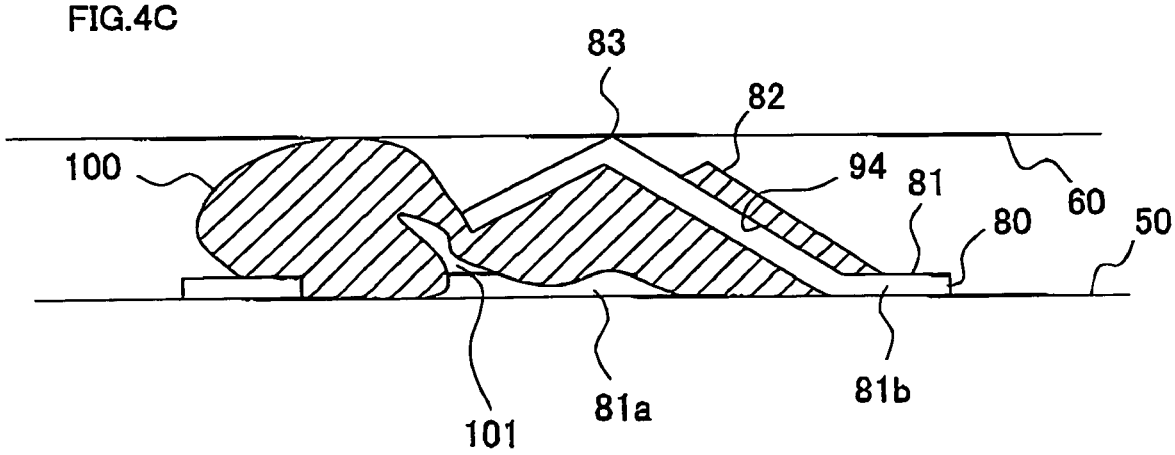
Figure 5A:
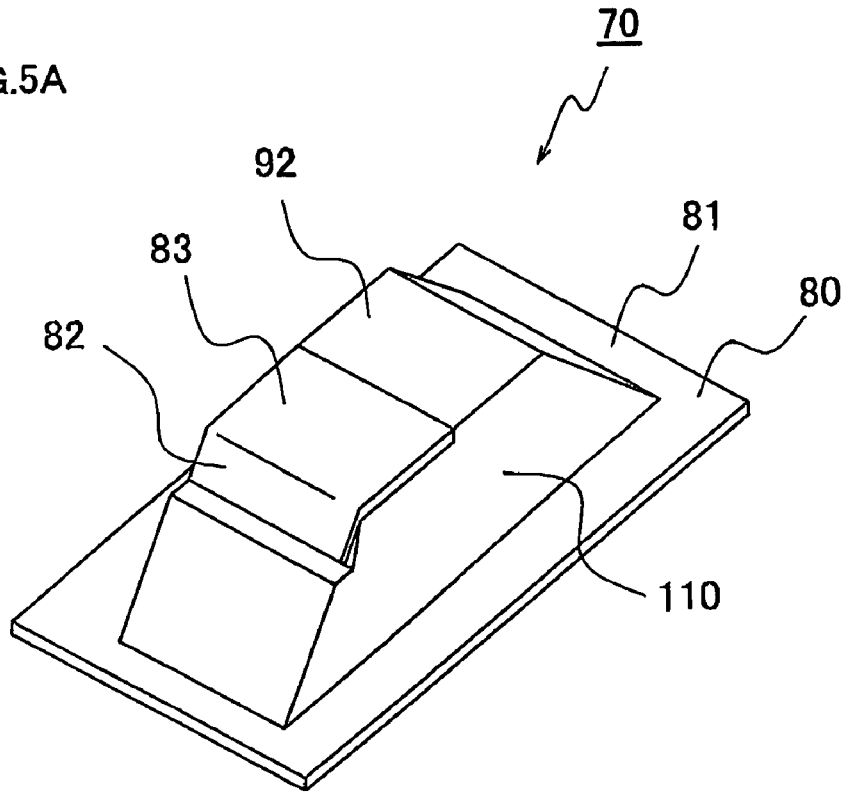
FIG. 5A and FIG. 5B are a top perspective view and a bottom perspective view of the contact member according to a third embodiment of the invention.
Figure 5B:
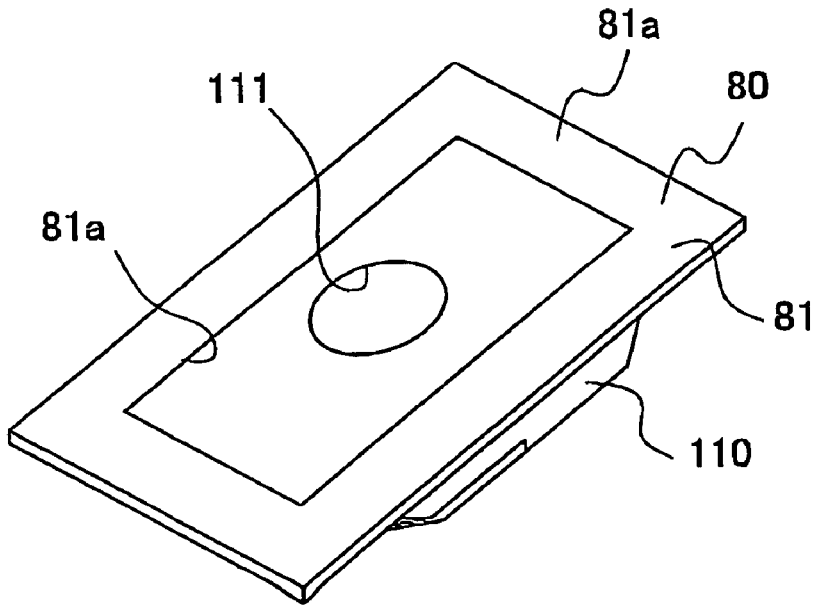

The elastomeric body 100 comprises an upper surface 92 which is identical to the first embodiment. In the joint hole 94, that is also the same as in the first embodiment, the elastomeric body 100 is connected to the supporting spring part 82 This contact member 70 is mounted on a printed circuit board 50 for use as in the first embodiment (refer to FIGS. 4B and 4C). In FIGS. 4A, 4B, and 4C, the circuit pattern 51 and the solder paste 51*a* disposed between the joint surface 81*b* and the printed circuit board 50 are not shown in order to simplify the figures. After the contact member 70 is mounted on the surface of the printed circuit board 50, the contact part 83 is pressed against a grounding conductor 60, such as a housing or the like, by the closing of the housing accommodating the printed circuit board 50 (refer to FIGS. 4B and C).

The distance between the printed circuit board 50 and the grounding conductor 60, interposing the contact member 70 therebetween, is set to be smaller than the height of the contact member 70 (measured from a joint surface 81*b* to an upper surface of the contact part 83) when the contact member 70 is not subjected to an external force. Consequently, a pressing force from the grounding conductor 60 is applied to the contact part 83.

As illustrated in FIG. 4B, because of this pressing force, the supporting spring part 82 is elastically deformed in such a manner that it collapses around a connecting part between the supporting spring part 82 and the base part 81. Additionally, this pressing force acts upon the elastomeric body 100 either through the supporting spring part 82 and the contact part 83, or directly, resulting in the elastic deformation of the elastomeric body 100 as if the elastomeric body 100 were crushed.

The pressing force applied to the contact part 83 acts upon the elastomeric body 100 as well, so that the elastomeric body 100 adds to the overall resistance and the result is that the contact member 70 is not excessively deformed. Therefore, even if the force to elastically deform the contact member 70 becomes excessive as in the situation above, the contact part 83 and the supporting spring part 82 can avoid being only plastically deformed and losing the spring characteristics.

When the elastomeric body 100 is elastically deformed in this manner, the side hole 101 becomes a deformation allowing space for the elastomeric body 100. As a result, when the supporting spring part 82 is elastically deformed in a direction that brings the contact part 83 closer to the base part 81, the resistance of the elastomeric body 100 is initially slight. In short, the effect to inhibit the plastic deformation of the parts is enhanced, because excessive force is applied to neither the supporting spring part 82 nor the contact part 83.

Also, when the amount of elastic deformation of the contact member 70 is small (at an early stage of deformation by pressing) as illustrated in FIG. 4B, the existence of the side hole 101 facilitates the deformation of the elastomeric body 100, thus allowing it to be deformed as shown in FIG. 4B with relatively little force. In this state, the end part of the contact part 83 engages the elastomeric body 100, resulting in an elastic repulsive force being generated in the elastomeric body 100 and suppressing the excessive deformation of the contact member 70.

When the amount of deformation is increased as illustrated in FIG. 4C, the side hole 101 is mostly contracted and the elastomeric body 100 starts shifting from elastic deformation to compressive deformation. This makes the elastic repulsive force of the elastomeric body 100 larger than initially in order to support the contact part 83 and the supporting spring part 82. Consequently, the elastomeric body 100 inhibits these parts from being permanently deformed over the elastic limit; in other words, the effects of plastic deformation of the supporting spring part 82 and the contact part 83 are suppressed.

Although the elastomeric body 100 is disposed on the upper side of the base part 81, the grounding conductor 60, which elastically deforms the contact member 70, firstly abuts the contact part 83 (and the upper face 92 of the elastomeric body 100). Therefore, the elastomeric body 100 does not disturb the electric contact between the grounding conductor 60 and the contact part 83.

After the grounding conductor 60 is removed from the contact member 70 and the pressing force is released by the opening of the housing or the like, the elastomeric body 100 recovers elastically. Accordingly, even if the spring characteristics of the supporting spring part 82, which is deformed by the pressure of the grounding conductor 60, are lowered and the recovery ability of the spring part 82 is decreased, the elastomeric body 100 compensates for some of the lost spring characteristics and provides a sufficient recovery ability. For this reason, if the spring characteristics of the thin sheet member 80 are decreased (or lost), the contact part 83 can return sufficiently close to its original state. Therefore, for example, when the housing is opened and closed repeatedly, the contact between the contact member 70 and the grounding conductor 60 is maintained, inhibiting conductive failure.

Furthermore, as the elastomeric body 100 is attached to the supporting spring part 82 by having a part of the supporting spring part 82 penetrate into the joint hole 94, there is no risk that elastomeric body 100 will be removed from the supporting spring part 82 (or, the thin sheet member 80) because of adhesion failure or the deterioration of an adhesive. There is no need to additionally adhere the elastomeric body 100 and the supporting spring part 82 with separate adhesive or the like, so it is possible to use hard-to-adhere materials for the elastomeric body 100.

In the present embodiment, a configuration is adopted that the elastomeric body 100 is in contact with the contact part 83 and the base part 81 even in the state in which an eternal force, which would cause the contact member 70 to be elastically deformed, is not applied to the contact member 70. Consequently, when the external force, which would result in the contact part 83 being elastically deformed in the direction of the base part 81, is applied, the external force is immediately applied to the elastomeric body 100 as well.

However, such a configuration may also be adopted that the elastomeric body 100 is in contact with neither the contact part 83 nor the base part 81 in the state in which an external force, necessary to cause elastic deformation, is not applied to the contact member 70. Only when the contact part 83 is displaced toward the base part 81 by more than a predetermined amount, the external force of the elastic deformation will be applied to the elastomeric body 100 as well. By using this configuration, for example, when the amount of displacement of the contact part 83 (and/or the amount of elastic deformation of the supporting spring part 82) is small, only the elastic repulsive force of the thin sheet member 80 maintains the abutting conduction between the contact part 83 and the grounding conductor 60. Subsequently, the elastomeric body 100 primarily inhibits the amount of elastic deformation of the supporting spring part 82 that is excessive.

Furthermore, the upper surface of the contact part 83 in the present embodiment is flat. This surface becomes an attachment surface that can be grasped with an automatic mounting machine. This flat surface is grasped by the automatic mounting machine, allowing the contact member 70 to be mounted onto the printed circuit board 50. In this situation, the upper surface 92 of the elastomeric body 100 may also become an attachment surface, so that some deviation of the grasping position by the automatic mounting machine does not result in problems.

[Third Embodiment]

The third embodiment uses an elastomeric body (with the same type of material as in the first embodiment) having a longitudinal hole. The components with the same configurations are denoted with the same reference numerals and the description of these components may not be repeated due to similarities and descriptions of the first embodiment.

As illustrated in FIGS. 5A, and 5B, and FIGS. 6A, 6B, and 6C, an elastomeric body 110 of the third embodiment is provided with a cylindrically configured longitudinal hole 111. The longitudinal hole 111 has a bottom opening in the area defined by the longitudinal hole 81*a*. While the longitudinal hole 111 may have an open top and the top reaches the undersurface of the contact part 83, in this embodiment the top of the longitudinal hole 111 is not opened thoroughly. About half of the diameter of the open top is covered by the flat upper surface 92, which lies along the same plane as the upper surface of the contact part 83.

Figure 6A:
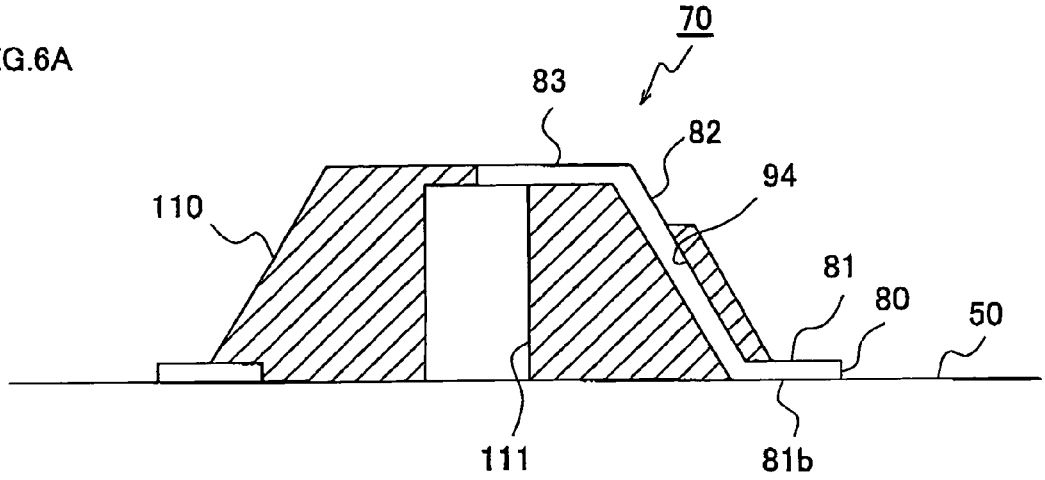
FIG. 6A is a cross-sectional view showing the state in which the contact member is mounted on a printed circuit board, according to the third embodiment of the invention.
Figure 6B:
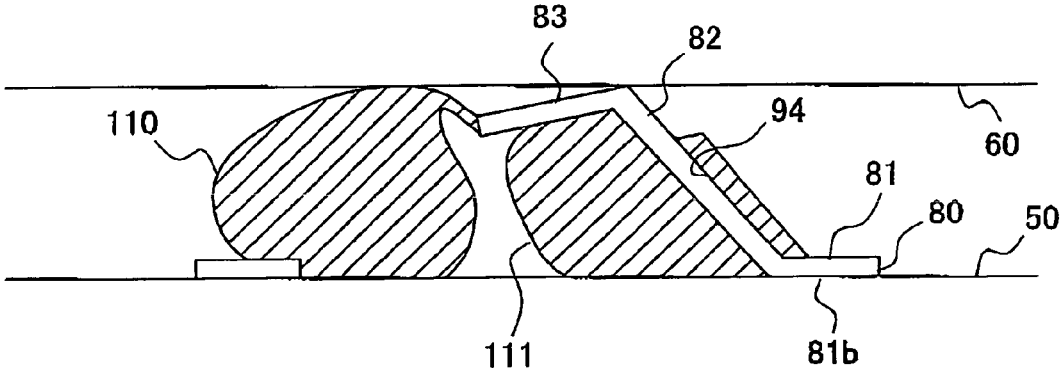
FIG. 6B is an explanatory view at the time the deforming amount of the contact member is small, according to the third embodiment of the invention.
Figure 6C:
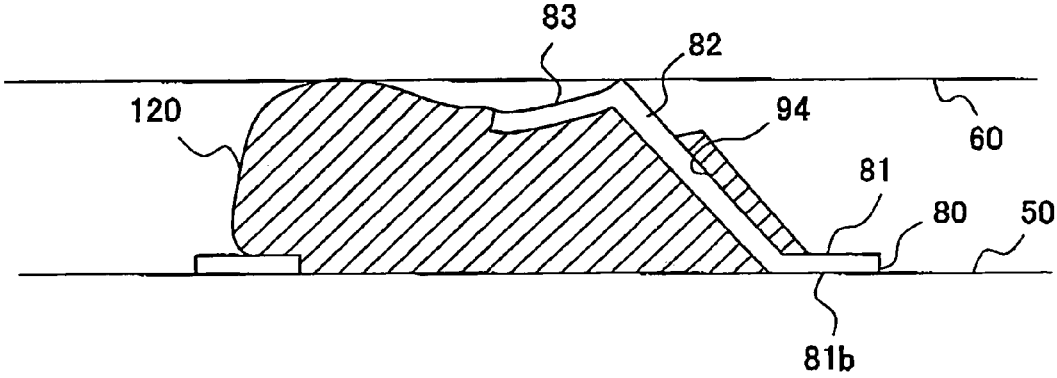
FIG. 6C is an explanatory view to show the case in which an elastomeric body without a hollow cavity is used for comparison.
Figure 7:
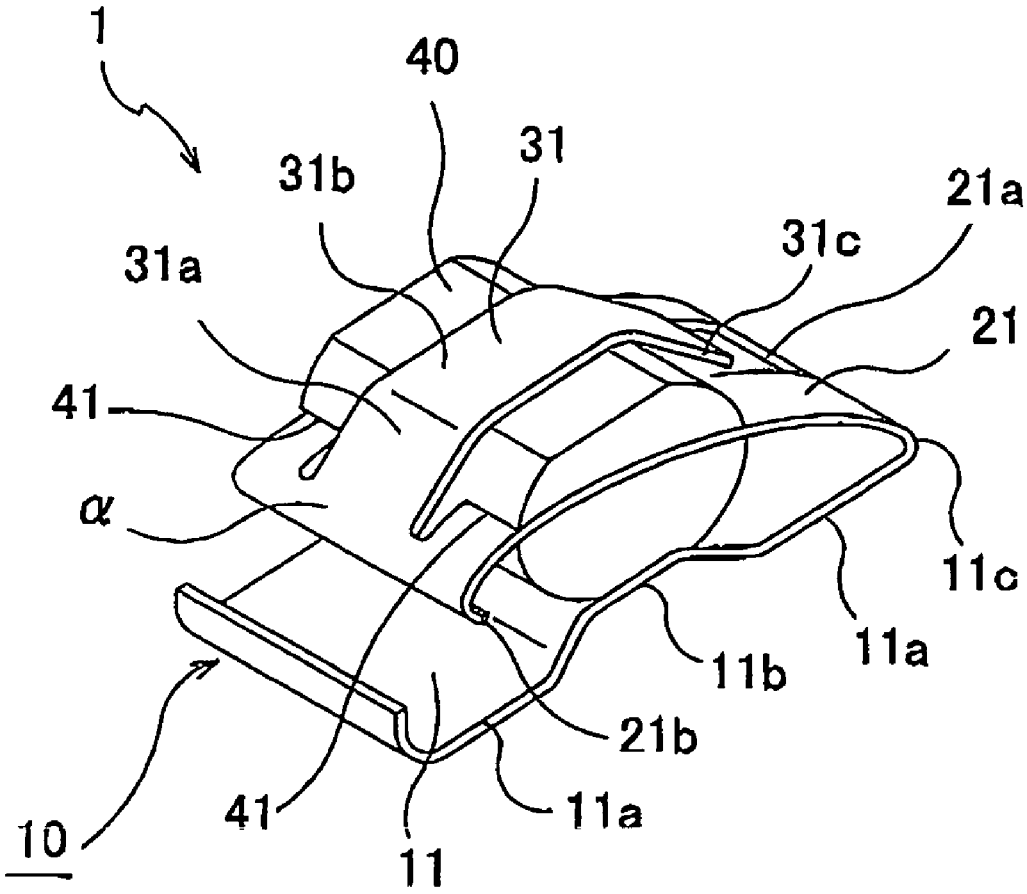
FIG. 7 is a perspective view showing the entire appearance of the contact member according to a fourth embodiment of the invention.
Figure 8A:
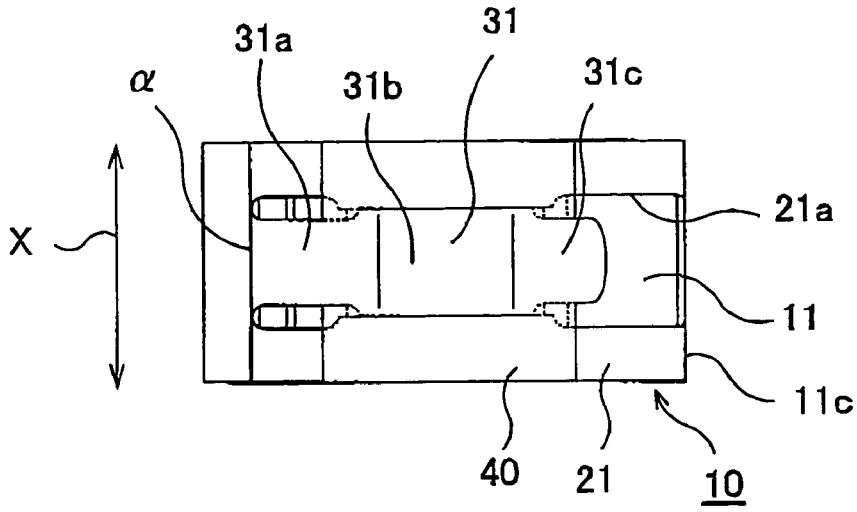
FIG. 8A is a plan view of the contact member according to the fourth embodiment of the invention.
Figure 8B:
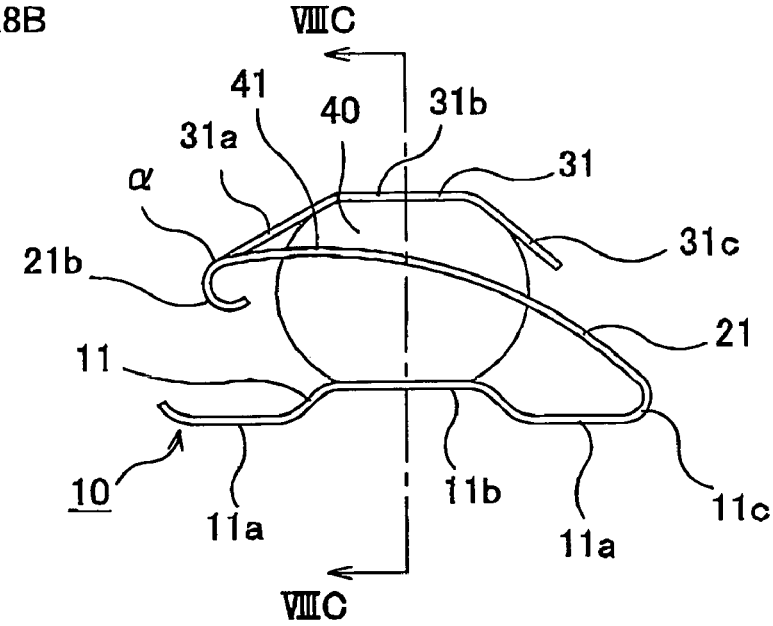
FIG. 8B is a side view of the contact member according to the fourth embodiment of the invention.
Figure 8C:
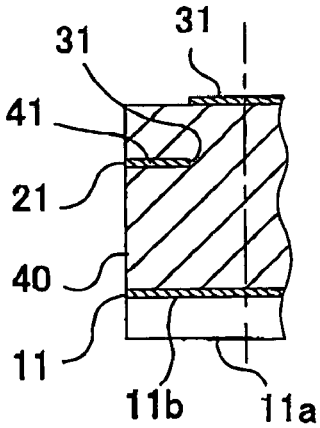
FIG. 8C is a cross-sectional view taken along line IIIC—IIIC of the contact member according to the fourth embodiment of the invention.

The elastomeric body 110 is connected to the supporting spring part 82 by a joint hole 94 which is identical to the first embodiment. This contact member 70 is also mounted on a printed circuit board 50 for use as in the first embodiment (refer to FIG. 6B). In FIGS. 6A, 6B, and 6C, the circuit pattern 51 and the solder paste 51*a* disposed between the joint surface 81*b* and the printed circuit board 50 are not shown in order to simplify the figures. For the contact member 70 mounted on the surface of a printed circuit board 50 in this manner, the contact part 83 is pressed against a grounding conductor 60, such as a housing or the like, by the closing of the housing accommodating the printed circuit board 50.

The distance between the printed circuit board 50 and the grounding conductor 60, interposing the contact member 70 therebetween, is set to be smaller than the height of the contact member 70 (as measured from a joint surface 81*b* to the upper surface of the contact part 83) when the contact member 70 is not subjected to an external force. Consequently, a pressing force from the grounding conductor 60 is applied to the contact part 83.

As illustrated in FIG. 6B, because of this pressing force, the supporting spring part 82 is elastically deformed in such a manner that it collapses around a connecting part located between the supporting part 82 and a base part 81. Additionally, this pressing force acts upon the elastomeric body 110 either through the supporting spring part 82 and the contact part 83, or directly, resulting in elastic deformation of the elastomeric body 110 as it is crushed.

The pressing force applied to the contact part 83 acts upon the elastomeric body 110 as well, so that the elastomeric body 110 adds to the resistance and the contact member 70 is not excessively deformed. Therefore, even if the force to elastically deform the contact member 70 becomes excessive as described above, the result is avoided that the contact part 83 and the supporting spring part 82 are non-recoverably plastically deformed and that the spring characteristics of the parts are lost.

When the elastomeric body 110 is elastically deformed in this way, the longitudinal hole 111 becomes a deformation allowing space for the elastomeric body 110. As a result, when the supporting spring part 82 is elastically deformed in the direction that makes the contact part 83 closer to the base part 81, the resistance of the elastomeric body 110 is initially small. Consequently, the effect to inhibit plastic deformation is enhanced because excessive force is not applied to the supporting spring part 82 and the contact part 83. Especially since the underside of the end part of the contact part 83 is positioned over the longitudinal hole 111, thus preferably inhibiting excessive force being applied to the end part of the contact part 83 (i.e., potentially resulting in deformation of this part).

FIG. 6C shows the case in which an elastomeric body 120, without the longitudinal hole 111, is used for comparison. In this case, the repulsive force of the elastomeric body 120 is generated in the direction so that the contact part 83 is bent away or spread apart from the supporting spring part 82. Thus, there is a risk that the bend forming the joint between the contact part 83 and the supporting spring part 82 is spread out and plastically deformed.

Although the elastomeric body 110 is disposed on the upper side of the base part 81, the grounding conductor 60, which elastically deforms the contact member 70, firstly abuts the contact part 83 (and the uppersurface 92 of the elastomeric body 110). Therefore, the elastomeric body 110 does not disturb the electric contact formed between the grounding conductor 60 and the contact part 83.

After the grounding conductor 60 is removed from the contact member 70 and the pressing force is released by the opening of the housing or the like, the elastomeric body 110 experiences an elastic recovery. Accordingly, even if the spring characteristic of the supporting spring part 82, which is deformed by the pressure of the grounding conductor 60, is lowered and the recovery ability is decreased, the elastomeric body 110 can compensate for some of the lost spring characteristics and provide a sufficient recovery ability. For this reason, even if the spring characteristic of the thin sheet member 80 is decreased (or lost), the contact part 83 can return sufficiently toward its original state. Therefore, for example, when the housing is opened and closed repeatedly, the contact between the contact member 70 and the grounding conductor 60 is maintained, thus inhibiting conductive failure.

Furthermore, as the elastomeric body 110 is attached to the supporting spring part 82 by using a part of the supporting spring part 82 penetrating into the joint hole 94 as a securing means, there is no risk that elastomeric body 110 is removed from the supporting spring part 82 (or, the thin sheet member 80) solely because of adhesion failure or the deterioration of an adhesive. It is not necessary to provide additional securing means between the elastomeric body 110 and the supporting spring part 82, such as with an adhesive or the like, so it is possible to use hard-to-adhere materials for the elastomeric body 110.

In the present embodiment, a configuration is adopted such that the elastomeric body 110 is in contact with the contact part 83 and the base part 81 even in an unstressed state. Consequently, when the external force, which causes the contact part 83 to be elastically deformed toward the base part 81, is applied, it is immediately applied to the elastomeric body 110 as well.

A configuration may also be adopted such that the elastomeric body 110 is in contact with neither the contact part 83 nor the base part 81 in the state in which an external force able to cause elastic deformation is not applied to the contact member 70. In this configuration, when the contact part 83 is displaced to the base part 81 by more than a predetermined amount, the external force of the elastic deformation is only then applied to the elastomeric body 110 as well. By doing this, for example, when the amount of displacement of the contact part 88 (and/or the amount of elastic deformation of the supporting spring part 82) is small, only the elastic repulsive force of the thin sheet member 80 maintains the abutting connection between the contact part 83 and the grounding conductor 60. Subsequently, the elastomeric body 110 of this configuration only inhibits the amount of deformation of the supporting spring part 82 that is excessive.

Furthermore, the upper surface of the contact part 83 of the present embodiment is flat, which allows it to become an attachment surface that can be grasped with an automatic mounting machine. Therefore, this flat surface is subsequently grasped by the automatic mounting machine, allowing the contact member 70 to be mounted upon the printed circuit board 50. On this occasion, as the upper surface 92 of the elastomeric body 110 may also become an attachment surface, small deviations of the grasping position with the automatic mounting machine does not cause any problems.

[Fourth Embodiment]

As illustrated in FIG. 7 and FIGS. 8A, 8B, and 8C, a contact member 1 is shown which comprises a thin sheet member 10 and an elastomeric body 40.

A thin sheet member 10 is made up of plate metal (i.e., a material such as beryllium copper and phosphor bronze), and its thickness is in the range of 0.3 mm to 0.8 mm. Known press operations such as stamping out and bending are performed to the thin sheet member 10. A base portion 11, a supporting spring portion 21, and a contact portion 31 are provided thereto.

The base part 11 is in an approximately rectangular shape, and includes a concave portion 11*b* in a middle area of the base part 11 in its width direction. Both areas to the side of this concave portion 11*b* are flat shaped and are referred to as joint surfaces 11*a*. The joint surfaces 11*a* are soldered onto a circuit pattern on a printed circuit board.

One end of the base part 11 is curved in an arc, while the other end is bent back in the direction opposing a joint surface 11*a*, forming a U-shape. This bending part 11*c* becomes a joint part with the supporting spring part 21.

The entire supporting spring part 21 is an extremely gentle curve (the radius of curvature is relatively large). The supporting spring part 21 is bent in such a manner that the distance between the supporting spring part 21 and the base part 11 becomes greater as the supporting spring part 21 moves away from the bending part 11*c*. The supporting spring part 21 is also bent in such a manner that the inclination of the supporting spring part 21 relative to the base part 11 becomes gentler as the supporting spring part 21 approaches its terminal part. An edge 21*b* of the supporting spring part 21 is bent back in the direction of the base part 11, substantially forming a semicircle.

Then, a middle area of the supporting spring part 21 in the width direction (i.e., the direction shown by X in FIG. 8A) is cut and raised to form the contact part 31. The contact part 31 has a width approximately equal to one-third of the total width of the supporting spring portion 21 and is disposed in the direction opposite to the base part 11.

A contact part 31 comprises a connected part 31*a*, which is connected to the terminal part of the supporting spring part 21 and inclined in a direction away from the base part 11, a flat part 31*b* which is bent down from the connected part 31*a* and extends substantially parallel to the base part 11 (the joint surface 11*a*), and a free end part 31*c* which is bent further down from the flat part 31*b* and inclined in a direction toward the base part 11. The connected area between the connected part 31*a* and the supporting spring part 21 is referred to as a base end part α; the terminal of the free end part 31*c* is referred to as a free end.

Also, by cutting and raising the contact part 31, a substantially rectangular longitudinal hole 21*a* is formed in the middle area of the supporting spring part 21. The elastomeric body 40 is preferably a silicone elastomer which resists heating at 260° C. and has a cross section in the form of an elliptical bar like body. A deep slot 41 is provided to both end surfaces of the elastomeric body 40 as partially illustrated in FIG. 8C.

The elastomeric body 40 is disposed so as to be sandwiched between the base part 11 (the upper surface of the concave part 11*b*) and the contact part 31 (the under surface of the flat part 31*b*).

A part of the supporting spring part 21 enters the deep slot 41 of the elastomeric body 40, thereby attaching the elastomeric body 40 to the supporting spring part 21, i.e. the thin sheet member 10. Also, the elastomeric body 40 is positioned directly under the contact part 31; however, the elastomeric body 40 is connected to neither the contact part 31 nor the base part 11 (it is not adhesively joined or the like).

Figure 9A:
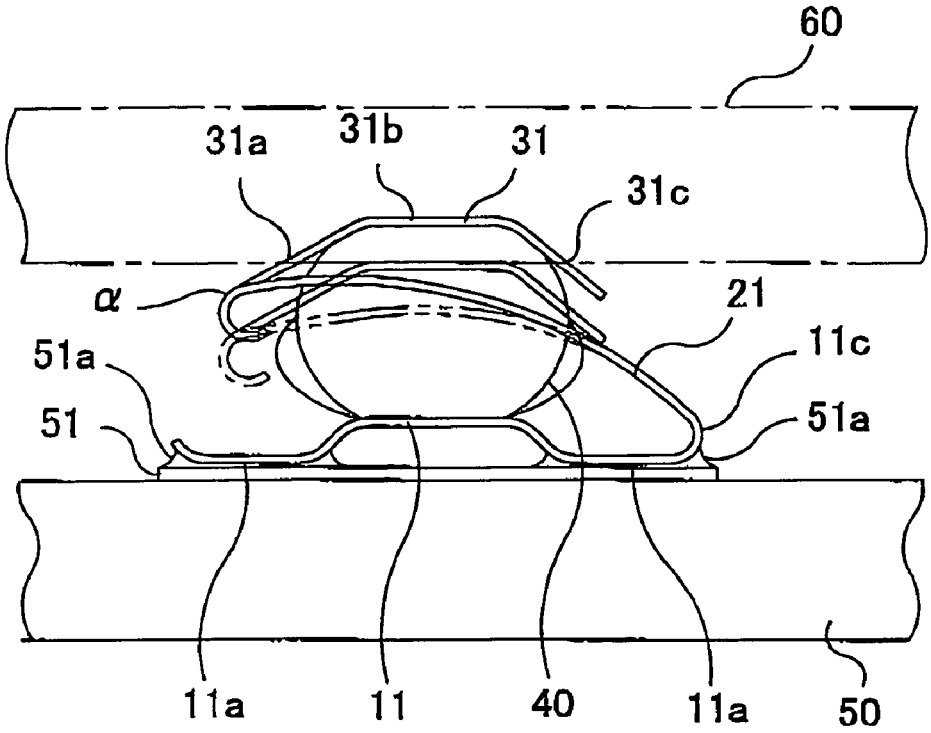
FIG. 9A is an explanatory view of the contact member according to the fourth embodiment of the invention.

This contact member 1, as illustrated in FIG. 9A, is mounted on a printed circuit board 50 for use. More specifically, the contact member 1 is movably held by the upper surface (attachment surface) of the flat part 31*b* being grasped by the vacuum suction of an automatic mounting machine. That contact member 1 is then disposed upon the printed circuit board 50 in such a manner that the joint surfaces 11*a* are provided onto a solder paste 51*a* on the printed circuit board 50. The solder paste 51*a* is subsequently melted by reflow soldering and cooled, thereby soldering the contact member 1 to the printed circuit board 50.

In the contact member 1 mounted on the surface of the printed circuit board 50 in the aforementioned manner, the flat part 31*b* is pressed against the grounding conductor 60, for example a housing or the like, by the closing of the housing accommodating the printed circuit board 50.

The distance between the printed circuit board 50 and the grounding conductor 60, interposing the contact member 1 therebetween, is set to be smaller than the height of the contact member 1 when the contact member 1 is not subjected to an external force. Consequently, a pressing force from the grounding conductor 60 is applied to the flat part 31*b*.

Because of this pressing force, the contact part 31 is elastically deformed around the base end part α, while the supporting spring part 21 is elastically deformed around the bending part 11*c*. In this situation, the flat part 31*b* is displaced while maintaining a substantially parallel relationship relative to the joint surfaces 11*a*. Additionally, this pressing force acts upon the elastomeric body 40 as well through the contact part 31, resulting in the elastic deformation of the elastomeric body 40 as if it were subject to a crushing type of force. FIG. 9A shows the state in which the contact part 31, the supporting spring part 21, and the elastomeric body 40, are all elastically deformed using chain double-dashed lines.

Figure 9B:
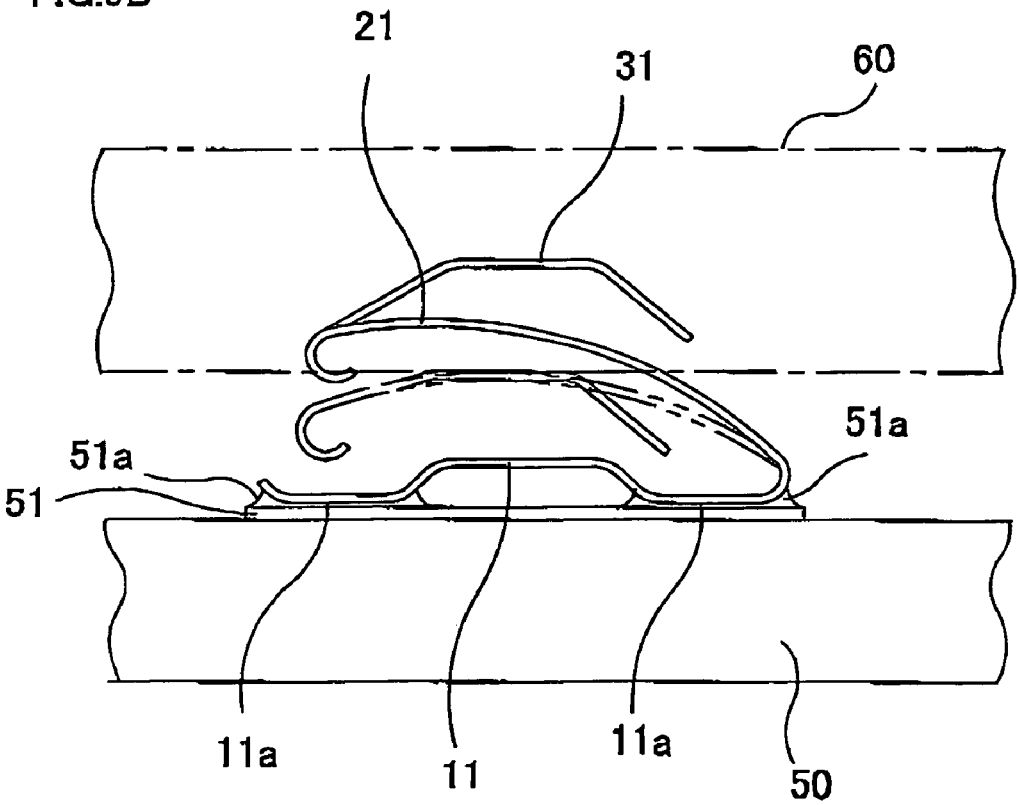
FIG. 9B is an explanatory view of the contact member of a comparative example without an elastomeric body for comparison.

FIG. 9B shows the state in which the elastomeric body 40 is not provided (illustrating with chain double-dashed lines the state in which the contact part 31 and the supporting spring part 21 are elastically deformed). In the case shown in FIG. 9A, unlike in the case shown in FIG. 9B, the pressing force applied to the contact part 31 acts upon the elastomeric body 40 as well, so that the elastomeric body 40 provides resistance and the contact member 1 is not excessively deformed. Therefore, even if the force to elastically deform the contact part 31 becomes excessive as shown above, the contact part 31 is inhibited from being plastically deformed and losing its spring characteristics.

The grounding conductor 60, which contacts the contact part 31 and elastically deforms this, firstly abuts the contact part 31 (specifically the flat part 31*b*), because the elastomeric body 40 is sandwiched between the base part 11 and the contact part 31. Therefore, the elastomeric body 40 does not disrupt the electric contact between the grounding conductor 60 and the contact part 31.

After the grounding conductor 60 is removed from the flat part 31*b* and the pressing force is released by the opening of the housing or the like, the elastomeric body 40 undergoes an elastic recovery. Accordingly, even if the spring characteristics of the contact part 31, which is deformed by the pressure of the grounding conductor 60, are reduced and the recovery ability is decreased, the elastomeric body 40 can compensate for the spring characteristics and provide a sufficient recovery ability. For this reason, if the spring characteristics of the contact part 31 are decreased (or lost), the contact part 31 can sufficiently return toward the original state. Therefore, for example, when the housing is frequently opened and closed, the contact between the contact member 1 and the grounding conductor 60 is maintained, inhibiting conductive failure.

Furthermore, there is no risk that elastomeric body 40 is unintentionally or accidentally removed from the supporting spring part 21 (i.e., the thin sheet member. 10) because of either adhesion failure or deterioration of an adhesive for example, because the elastomeric body 40 is attached to the supporting spring part 21 by causing a part of the supporting spring part 21 to penetrate the deep slot 41 within each end of the elastomeric body 40. There is no need to supplemently adhere the elastomeric body 40 and the supporting spring part 21 with an adhesive or similar substance, so it is possible to use hard-to-adhere materials for the elastomeric body 40.

Meanwhile, in the present embodiment, such a configuration is adopted that the elastomeric body 40 is in contact with the contact part 31 and the base part 11 even in the state in which the eternal force, which causes the contact part 31 to be elastically deformed in the direction of the base part 11, is not applied to the contact member 1. Consequently, when the external force is applied, it is immediately applied to the elastomeric body 40 as well.

Such a configuration may also be adopted that the elastomeric body 40 is in contact with neither the contact part 31 nor the base part 11 when the contact member 1 is unstressed, and that after the contact part 31 is elastically displaced in the direction of the base part 11 by more than a predetermined amount, the external force of the elastic deformation is applied to the elastomeric body 40 as well. For example, when the amount of elastic deformation of the contact part 31 is small, only the elastic repulsive force of the thin sheet member 10 maintains the abutting connection between the contact part 31 and the grounding conductor 60. Subsequently, the elastomeric body 40 only inhibits when the elastic deformation of the contact part 31 becomes excessive.

In addition, the contact part 31 of the contact member 1 of the present embodiment is provided with the flat part 31*b* which also functions as an attachment surface that can be grasped with an automatic mounting machine. Therefore, when the flat part 31*b* is grasped by an automatic mounting machine, the contact member 1 can be mounted on the printed circuit 50.

Further in addition, the flat part 31*b* and the joint surface 11*a* are approximately parallel to each other in the condition ill which the external force able to cause elastic deformation of the contact part 31 is not applied to the contact member 1. Even when the contact part 31 is elastically deformed in a direction that makes the free end part 31*c* approach the base part 11, the flat part 31*b* is able to maintain a substantially parallel relationship relative to the joint surface 11*a*. Therefore, even when elastic deformation is caused by abutment onto a vacuum suction nozzle of the vacuum suction automatic mounting machine, gaps between the nozzle and the flat part 31*b* are restrained. The grasp of the contact member 1 can be thereby performed effectively and the efficiency in the automatic mounting operation can be improved.

[Comparative Experiment]

Figure 13A:
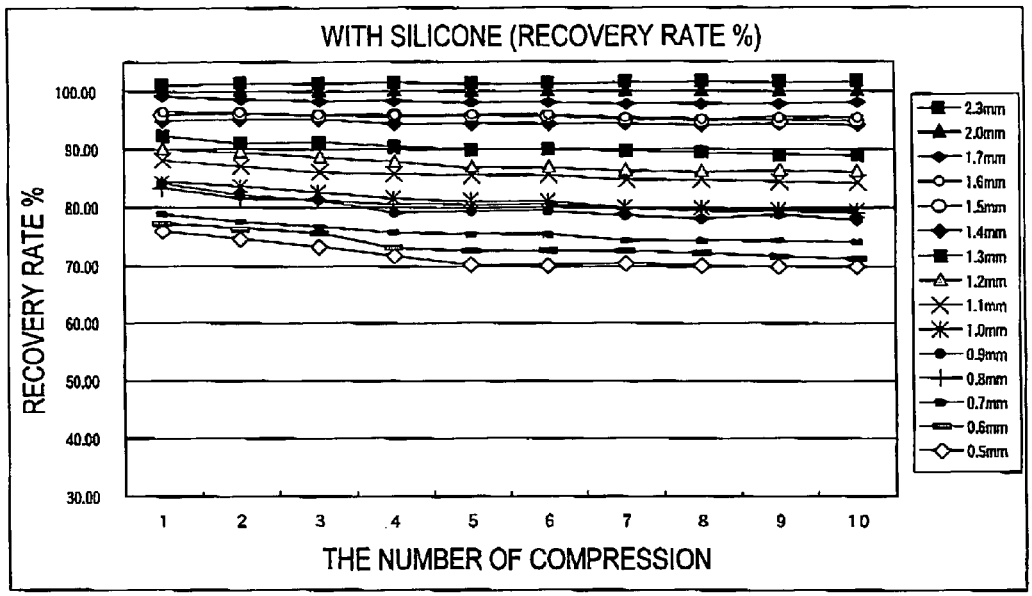
FIGS. 13A and 13B are graphs of a compressive and recovery experiment of the contact member according to the fourth embodiment of the invention.
Figure 13B:
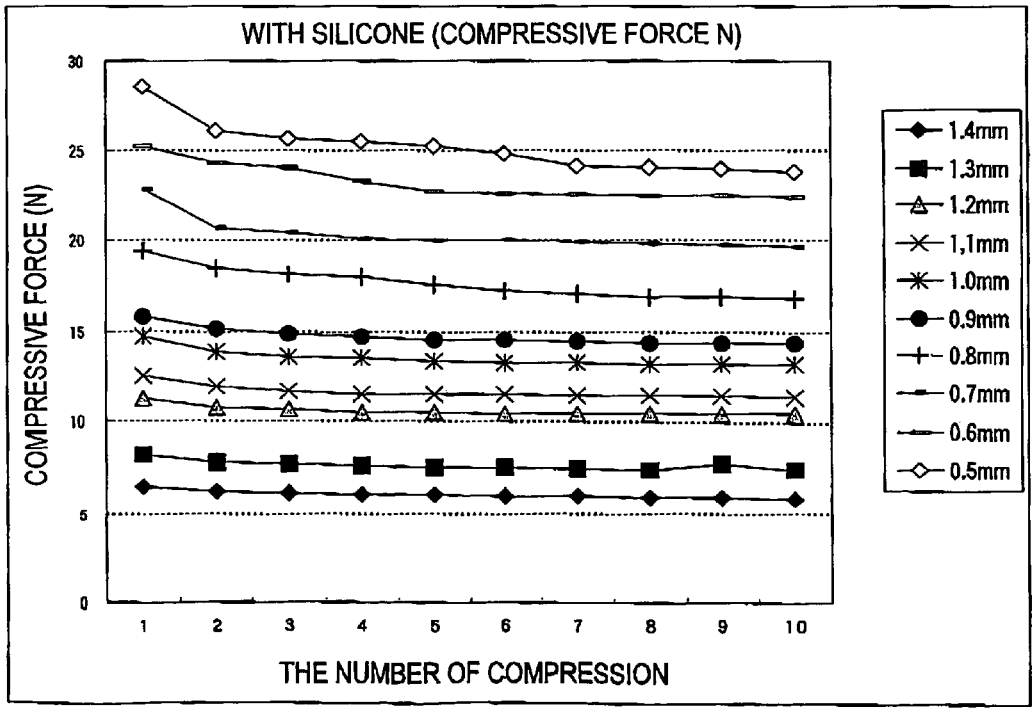

The contact member 1 of the fourth embodiment and a contact member of a comparative example, which does not include the elastomeric body 40 and is only composed of the thin sheet member, are used for illustrative comparison. The comparison involves loading a contact part 31 (a flat part 31*b*) and measuring the recovery ability. The results are illustrated in FIG. 13A (the contact of the embodiment) and in FIG. 14A (the contact of the comparative example). FIG. 13B and FIG. 14B are graphs of loading (compressive force).

Figure 14A:
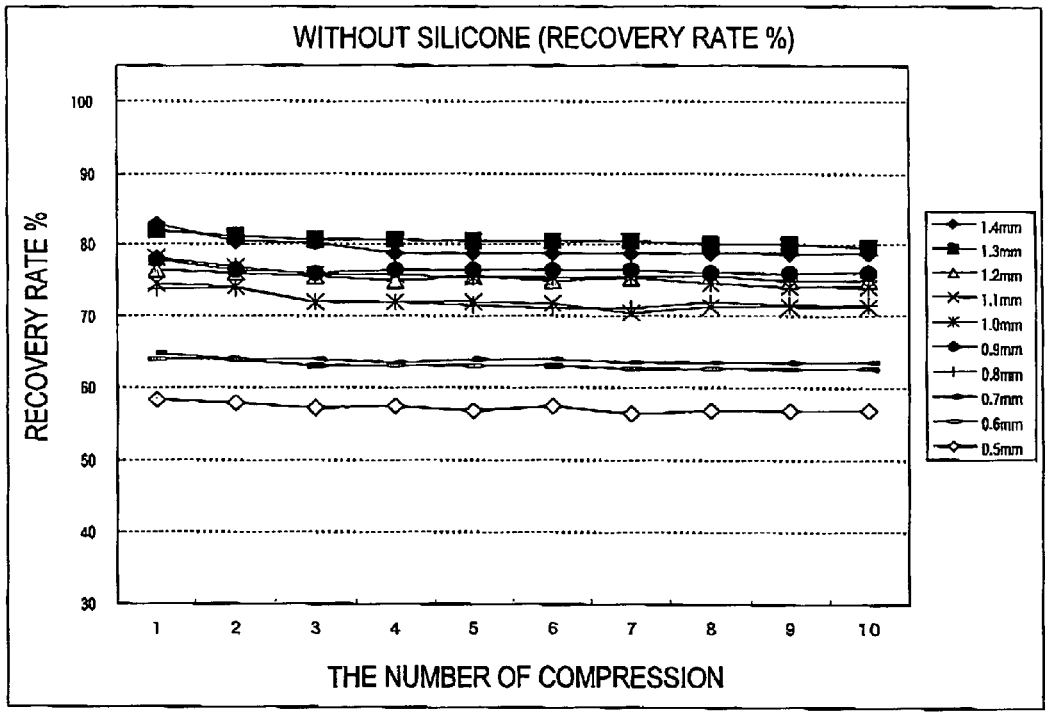
FIGS. 14A and 14B are graphs of a compressive and recovery experiment of the contact member of a comparative example.
Figure 14B:
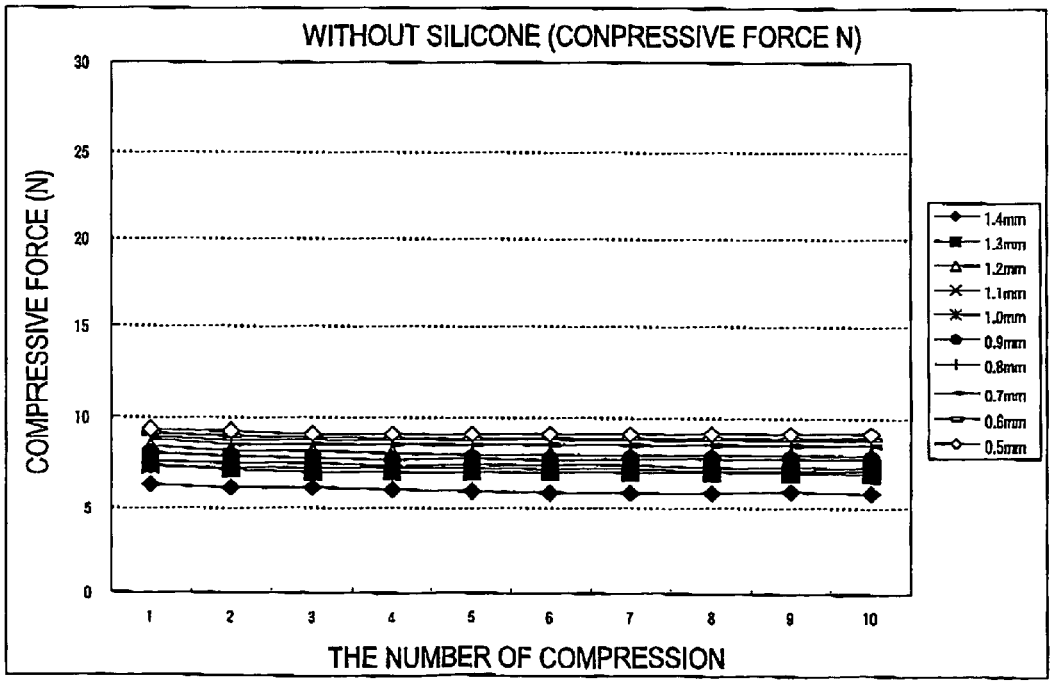

It is clear from the comparison between FIG. 13A and FIG. 14A that the contact member 1 of the embodiment has a higher recovery rate from compressive deformation.

[Modified Example of a Thin Sheet Member]

Figure 10A:
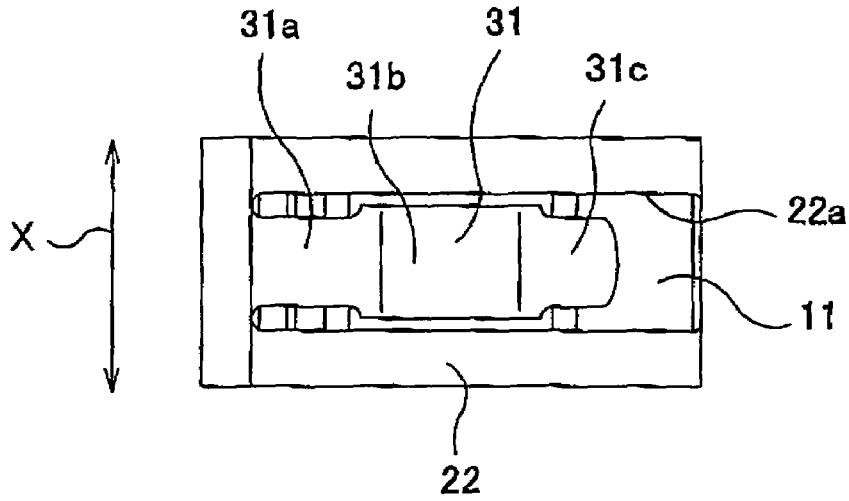
FIGS. 10A, 10B and 10C are explanatory views of modified examples of the thin sheet member.

In the aforementioned fourth embodiment, the width of the middle area of a longitudinal hole 21*a* in its longitudinal direction is substantially the same as the width of the flat part 31*b* of a contact part 31. As a modification of this, as illustrated in FIG. 10A, a supporting spring part 22 may be provided with a longitudinal hole 22*a* having a width wider than that of the flat part 31*b* of the contact part 31.

Figure 10B:
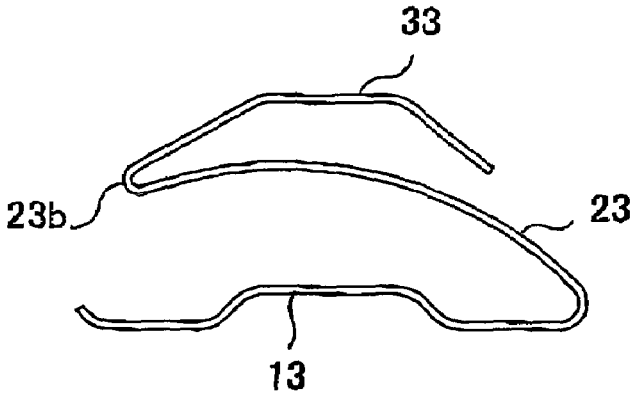
Figure 10C:
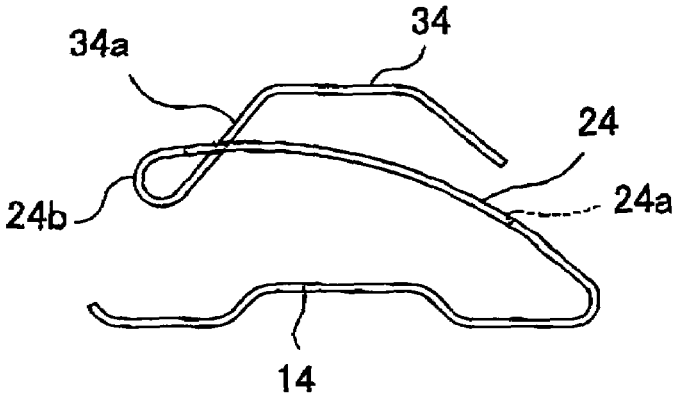
Figure 11A:
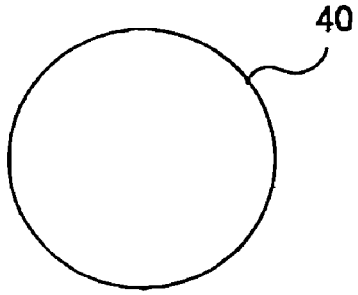
FIGS. 11A, 11B, 11C and 11D are explanatory views of modified examples of the elastomeric body.
Figure 11B:
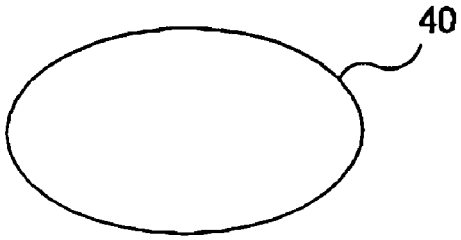
Figure 11C:
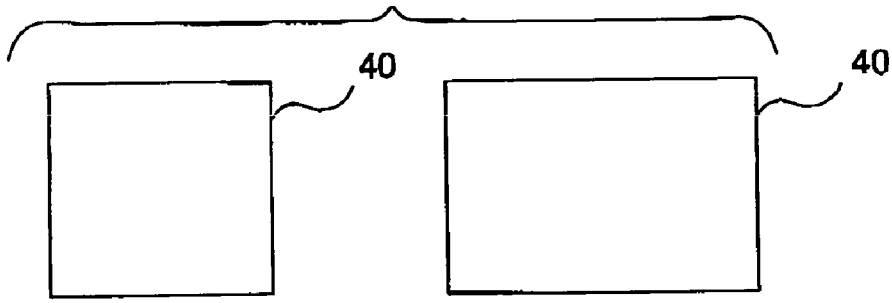
Figure 11D:
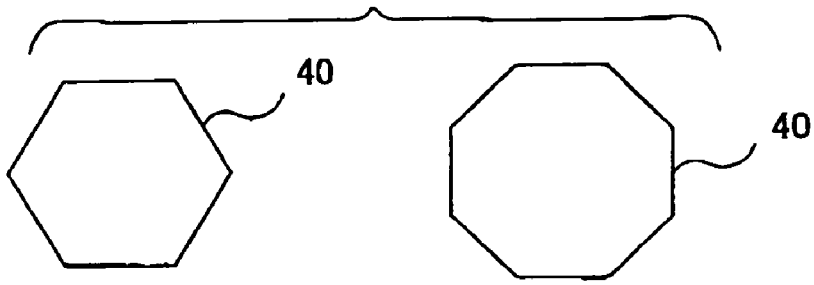

Also, in the aforementioned fourth embodiment, the contact part 31 is formed by cutting and raising a portion of a supporting spring part 21; however, a contact part may also be formed as an extension of the supporting spring part and bent from the terminal part thereof. More particularly, as shown in FIG. 10B, a contact part 33 may be formed by bending an extension back from an end part 23*b* of a supporting spring part 23 in the direction opposite to a base part 13. Alternatively, as shown in FIG. 10C, an end 24*b* of a supporting spring part 24 may be bent around in the direction of a base part 14, thereby forming a contact part 34, which has a connected part 34*a* penetrating through a longitudinal hole 24*a* of the supporting spring part 24.

[Modified Example of an Elastomeric Body]

In the above described fourth embodiment, an elastomeric body 40 whose cross section is approximately elliptical is used; however, the cross section thereof maybe circular (FIG. 11A), oval (FIG. 11B), square or rectangular (FIG. 11C), and polygonal (FIG. 11(*d*)) or a combination of any of the above.

Figure 12:
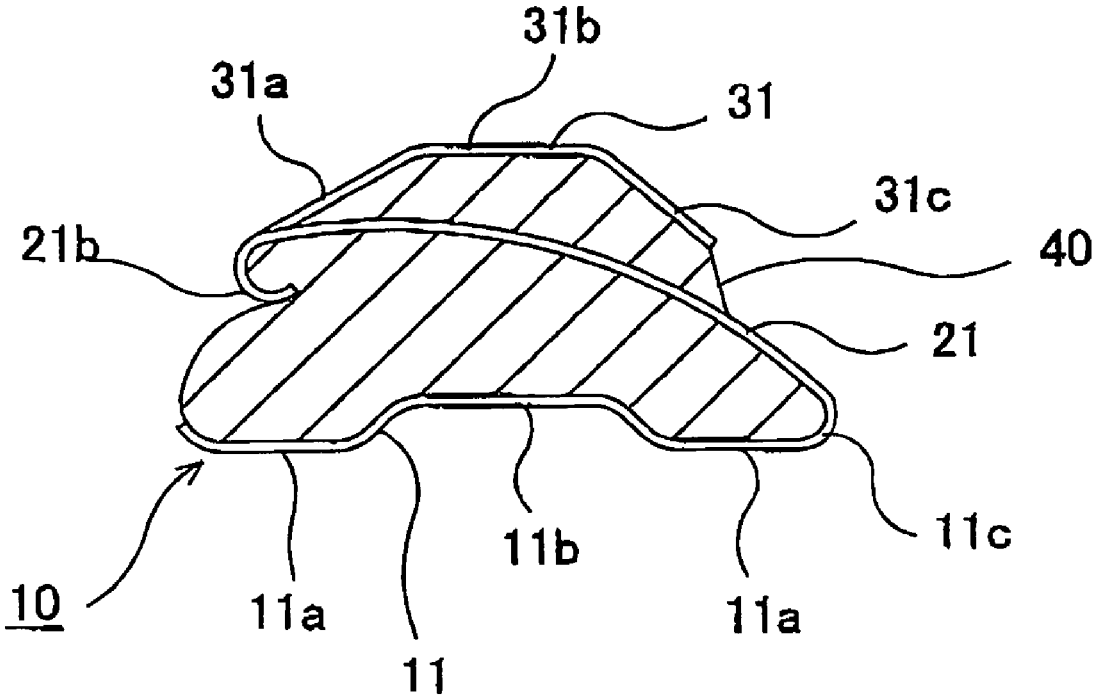
FIG. 12 is an explanatory view of modified examples of the elastomeric body.

Also, as shown in FIG. 12, it is possible to adopt such a configuration that approximately the whole space inside of the thin sheet member 10 may be filled with an elastomeric body 40 (hatching is performed for clarification).

All of the embodiments described may be used without separate fastening or adhering techniques. But this does not imply that the use of such techniques is prohibited within the scope of this invention, but only implies that they are not required.

In addition, specific types of material, shapes and/or configurations were described in an attempt to enable the embodiments of the invention. The scope of this invention includes combinations of geometric figures described as well as all obvious variations thereof, including but not limited to, the use of material with multiple densities and spring rates, conductive materials, cavities, holes, and other variations known or accepted by people skilled in the art.

The invention is not restricted to the embodiment as described above, and may be practiced or embodied in still other ways without departing from the subject matter thereof.

What is claimed is:

1. A contact member comprising:

a thin sheet conductive member, and an elastomeric body, wherein the thin sheet member comprises;

a base part of which at least a portion can be mounted to a surface of a printed circuit board;

a contact part which is provided to establish an electrical connection between a contact element and the surface of the printed circuit board; and a supporting spring part which is connected to the base part and to the contact part and supports the contact part in such a manner that the contact part can be deformed in a direction perpendicular to a plane containing the portion of the base part which can be mounted to the surface of a printed circuit board;

the elastomeric body is disposed between the base part and the contact part and the elastomeric body is attached to the supporting spring part by allowing a portion of the thin sheet member to penetrate inside of the elastomeric body;

wherein the elastomeric body is provided with a cavity located at least partially between the contact part and the base part and the cavity is open to at least three surfaces or the elastomeric body.

2. The contract member according to claim 1, wherein the elastomeric body is in contact with the contact part and the base part when the contact member is in an unloaded condition.

3. The contact member according to claim 1, wherein the contact part comprises an attachment surface which is able to be grasped by an automatic mounting machine.

4. The contact member according to claim 3, wherein the attachment surface and the base part are approximately parallel to each other when the contact member is in an unloaded condition, and wherein the attachment surface maintains a substantially parallel relationship relative to the base part when the contact part is elastically deformed in the direction perpendicular to a plane containing the portion of the base part which can be mounted to the surface of a printed circuit board.

5. The contact member according to claim 1, wherein the cavity is in substantially a shape of a trapezoid, and wherein the cavity extends across the width of the elastomeric body, wherein the width is defined across two opposing surfaces of the elastomeric body not directly contacting a surface of one of the components of the thin sheet member, wherein the surface of one of the components of the thin sheet member is in a direction perpendicular to a thickness of the thin sheet member.

6. The contact member according to claim 1, wherein the elastomeric body provides variable levels of resistance.

7. The contact member according to claim 1, wherein a cross-section of the elastomeric body taken along a plane intersecting a length and the contact part and the base part of the contact member is a geometric shape, wherein the length of the contact member is defined as a direction along the plane containing the portion of the base part which can be mounted to the surface of a printed circuit board from one end of a connection between the base part and the supporting spring part to an opposite end of the base part.

8. The contact member according to claim 1, wherein the elastomeric body can be heated to at least a temperature of 260° C.

9. The contact member according to claim 7, wherein the elastomeric body has a plurality of sides.

10. A contact member comprising:

a thin sheet conductive member, and an elastomeric body, wherein the thin sheet member comprises:

a base part of which at least a portion can be mounted to a surface of a printed circuit board;

a contact part which is provided to establish an electrical connection between a contact element and the surface of the printed circuit board; and a supporting spring part which is connected to the base part and to the contact part and supports the contact part in such a manner that the contact part can be deformed in a direction perpendicular to a plane containing the portion of the base part which can be mounted to the surface of a printed circuit board;

the elastomeric body is disposed between the base part and the contact part and the elastomeric body is attached to the supporting spring part by allowing a portion of the thin sheet member to penetrate inside of the elastomeric body;

a cross-section of the elastomeric body taken along a plane intersecting a length and the contact part and the base part of the contact member is a geometric shape, the length of the contact member is defined as a direction along the plane containing the portion of the base part which can be mounted to the surface of a printed circuit board from one end of a connection between the base part and the supporting spring part to an opposite end of the base part; and the elastomeric body has an elliptical cross-section.

11. A contact member comprising:

a thin sheet conductive member, and an elastomeric body, wherein the thin sheet member comprises:

a base part of which at least a portion can be mounted to a surface of a printed circuit board;

a contact part which is provided to establish an electrical connection between a contact element and the surface of the printed circuit board; and a supporting spring part which is connected to the base part and to the contact part and supports the contact part in such a manner that the contact part can be deformed in a direction perpendicular to a pane containing the portion of the base part which can be mounted to the surface of a printed circuit board;

the elastomeric body is disposed between the base part and the contact part and the elastomeric body is attached to the supporting spring part by allowing a portion of the thin sheet member to penetrate inside of the elastomeric body;

a cross-section of the elastomeric body taken along a plane intersecting a length and the contact part and the base part of the contact member is a geometric shape, and the length of the contact member is defined as a direction along the plane containing the portion of the base part which can be mounted to the surface of a printed circuit board from one end of a connection between the base part and the supporting spring part to an opposite end of the base part, and the elastomeric body has a circular cross-section.

12. A contact member comprising:

a thin sheet conductive member, and an elastomeric body, wherein the thin sheet member comprises:

a base part of which at least a portion can be mounted to a surface of a printed circuit board;

a contact part which is provided to establish an electrical connection between a contact element and the surface of the printed circuit board; and a supporting spring part which is connected to the base part and to the contact part and supports the contact part in such a manner that the contact part can be deformed in a direction perpendicular to a plane containing the portion of the base part which can be mounted to the surface of a printed circuit board;

the elastomeric body is disposed between the base part and the contact part and the elastomeric body is attached to the supporting spring part by allowing a portion of the thin sheet member to penetrate inside of the elastomeric body; and the elastomeric body is provided with a hollow cavity located at least partially between the contact part and the base part and the hollow cavity is open to at least one surface of the elastomeric body and the cavity remains hollow following installation with the printed circuit board, and when an exterior force is applied to the contact part, causing movement of the contact part toward the base part, the hollow cavity is deformed and facilitates deformation of the elastomeric body and elastic deformation of the contact part and the spring part, and the elastomeric body opposes the force causing movement of the contact part toward the base part to inhibit the contact part and the spring part from being plastically deformed.

13. The contact member according to claim 12, wherein the cavity is in a substantially cylindrical shape extending through a portion of the thickness of the elastomeric body.

14. The contact member according to claim 12, wherein the cavity is in a substantially cylindrical shape extending through the thickness of the elastomeric body, wherein the thickness is defined between the base part and the contact part.

15. The contact member according to claim 12, wherein the elastomeric body has a elliptical cross-section.

16. The contact member according to claim 12, wherein the elastomeric body has a circular cross-section.

17. The contact member according to claim 14, wherein the cavity is only open in a substantially semi-circular shape directly beneath the contact part; and wherein the elastomeric body is substantially flush with an upper surface of the contact part.

* * * * *